US012295441B2

(12) United States Patent
Pracht et al.

(10) Patent No.: US 12,295,441 B2
(45) Date of Patent: May 13, 2025

(54) SAFETY HELMET WITH A RESILIENTLY ATTACHED SHOCK-ABSORBING SHELL AND PROCESS FOR MANUFACTURING SAME

(71) Applicant: Dräger Safety AG & Co. KGaA, Lübeck (DE)

(72) Inventors: Steffen Pracht, Lübeck (DE); Jasser Rahmatyan, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 3 days.

(21) Appl. No.: 17/241,706

(22) Filed: Apr. 27, 2021

(65) Prior Publication Data

US 2021/0337908 A1 Nov. 4, 2021

(30) Foreign Application Priority Data

Apr. 30, 2020 (DE) ..... 102020002611.7

(51) Int. Cl.
*A42B 3/06* (2006.01)
*A42B 3/14* (2006.01)

(52) U.S. Cl.
CPC . *A42B 3/06* (2013.01); *A42B 3/14* (2013.01)

(58) Field of Classification Search
CPC .... A42B 3/06; A42B 3/04; A42B 3/12; A42B 3/14; A42B 3/121; A42B 3/145; A42B 3/064; A42B 3/142; A42B 3/147
USPC ..... 2/416
See application file for complete search history.

(56) References Cited

U.S. PATENT DOCUMENTS 1,199,629 A * 9/1916 Stocks ..... A42B 3/145 2/418
1,244,559 A * 10/1917 Stocks ..... A42B 3/064 2/416
3,237,201 A * 3/1966 Morgan ..... A42B 3/14 2/416
3,872,511 A * 3/1975 Nichols ..... A42B 3/121 267/114
4,032,127 A * 6/1977 Lipfert ..... A61G 13/009 2/420
4,307,471 A * 12/1981 Lovell ..... A42B 3/12 2/425

(Continued)

FOREIGN PATENT DOCUMENTS

CN 1251972 A 5/2000
CN 101573056 A 11/2009

(Continued)

*Primary Examiner* — Alissa L Hoey
(74) *Attorney, Agent, or Firm* — McGlew and Tuttle, P.C.

(57) ABSTRACT

A safety helmet (100) includes an arched helmet shell (2), an arched shock-absorbing shell (1), a holding ring (3, 11) and a resilient element (14). The holding ring (3, 11) is permanently connected to the helmet shell (2). The shock-absorbing shell (1) adjoins a holding ring edge. The resilient element (14) is supported at the holding ring (3, 11), projects over the holding ring edge and acts to move the shock-absorbing shell (1) away from the holding ring (3, 11) and to press shock-absorbing shell (1) against the helmet shell (2). A process for manufacturing such a safety helmet (100) is provided. According to the process, first the shock-absorbing shell (1) is placed first into the helmet shell (2) and the holding ring (3, 11) is then attached to the helmet shell (2).

19 Claims, 15 Drawing Sheets

(56) References Cited

U.S. PATENT DOCUMENTS

| | | | | | |
|---|---|---|---|---|---|
| 4,407,021 | A * | 10/1983 | Kralik | A42B 3/14 | 2/416 |
| 5,319,808 | A * | 6/1994 | Bishop | A42B 3/14 | 2/181.2 |
| 5,815,847 | A * | 10/1998 | Holden, Jr. | A42B 3/125 | 2/418 |
| 6,199,214 | B1 * | 3/2001 | Campbell | A42C 5/02 | 2/181.8 |
| 6,865,752 | B2 * | 3/2005 | Udelhofen | A42B 3/324 | 2/418 |
| 8,316,512 | B2 * | 11/2012 | Halldin | A42B 3/064 | 24/90.1 |
| 8,453,268 | B2 * | 6/2013 | Ahlgren | A42B 3/14 | 2/416 |
| 9,021,616 | B2 * | 5/2015 | Baty | A42B 3/14 | 2/416 |
| 10,092,056 | B2 * | 10/2018 | Durocher | A42B 3/125 | |
| 10,342,280 | B2 * | 7/2019 | Valentino, Sr. | A42B 3/064 | |
| 10,405,598 | B2 * | 9/2019 | Gotti | A42B 3/14 | |
| 10,463,100 | B2 * | 11/2019 | Gotti | A42B 3/283 | |
| 10,660,390 | B2 * | 5/2020 | Ku | A42B 3/064 | |
| 10,874,161 | B2 * | 12/2020 | Gotti | A42B 3/145 | |
| 10,966,480 | B1 * | 4/2021 | Liu | A42B 3/12 | |
| 11,147,335 | B2 * | 10/2021 | Pomering | A42B 3/32 | |
| 11,419,380 | B2 * | 8/2022 | Shaffer | A42B 3/14 | |
| 11,666,112 | B2 * | 6/2023 | Rogers | A42B 3/145 | 2/417 |
| 11,771,168 | B2 * | 10/2023 | Huh | A41D 20/00 | 2/209.11 |
| 11,864,616 | B2 * | 1/2024 | Rahmatyan | A42B 3/044 | |
| 2008/0256686 | A1 * | 10/2008 | Ferrara | B60R 21/045 | 2/413 |
| 2010/0043126 | A1 | 2/2010 | Morel | | |
| 2011/0265236 | A1 * | 11/2011 | Stoll | A41D 13/1184 | 2/9 |
| 2013/0019384 | A1 * | 1/2013 | Knight | A42B 3/063 | 2/455 |
| 2013/0167289 | A1 * | 7/2013 | Rensink | A42B 3/145 | 2/421 |
| 2014/0259286 | A1 * | 9/2014 | Boyle | A41D 20/00 | 2/181 |
| 2014/0259315 | A1 | 9/2014 | Durocher | | |
| 2016/0021965 | A1 * | 1/2016 | Mayerovitch | A42B 3/064 | 2/414 |
| 2016/0161222 | A1 * | 6/2016 | Lee | A42B 3/064 | 2/416 |
| 2017/0105470 | A1 * | 4/2017 | Eaton | A42B 3/064 | |
| 2017/0112222 | A1 * | 4/2017 | Gotti | A42B 3/08 | |
| 2017/0238643 | A1 * | 8/2017 | Pereira | A42B 3/14 | |
| 2021/0085012 | A1 * | 3/2021 | Alvaro | A42B 3/063 | |
| 2021/0337908 | A1 * | 11/2021 | Pracht | A42B 3/14 | |
| 2021/0337909 | A1 * | 11/2021 | Tolk | A42B 3/142 | |
| 2021/0337911 | A1 * | 11/2021 | Franke | A42B 3/145 | |
| 2021/0337915 | A1 * | 11/2021 | Franke | A42B 3/324 | |
| 2022/0183418 | A1 * | 6/2022 | Hajianpour | A42B 3/286 | |
| 2022/0400803 | A1 * | 12/2022 | Chernyshou | A42B 3/125 | |
| 2023/0023020 | A1 * | 1/2023 | Pomering | A44B 17/0076 | |
| 2024/0099415 | A1 * | 3/2024 | Rahmatyan | A42B 3/286 | |

FOREIGN PATENT DOCUMENTS

| | | | | |
|---|---|---|---|---|
| CN | 102905570 | A | 1/2013 | |
| DE | 102010050678 | B3 | 4/2012 | |
| DE | 102016008025 | A1 | 1/2018 | |
| DE | 102016010532 | A1 | 3/2018 | |
| DE | 102016010534 | A1 | 3/2018 | |
| EP | 1452101 | A1 | 9/2004 | |
| GB | 787583 | A | 12/1957 | |
| WO | 9846097 | A1 | 10/1998 | |
| WO | WO-2011139224 | A1 * | 11/2011 | A42B 3/04 |
| WO | 2012059081 | A2 | 5/2012 | |

* cited by examiner

SAFETY HELMET WITH A RESILIENTLY ATTACHED SHOCK-ABSORBING SHELL AND PROCESS FOR MANUFACTURING SAME

CROSS REFERENCE TO RELATED APPLICATIONS

This application claims the benefit of priority under 35 U.S.C. § 119 of German Application10 2020 002 611.7, filed Apr. 30, 2020, the entire contents of which are incorporated herein by reference.

TECHNICAL FIELD

The present invention pertains to a safety helmet comprising an arched helmet shell, an arched shock-absorbing shell and a holding ring. The present invention pertains, furthermore, to a process for manufacturing such a safety helmet.

TECHNICAL BACKGROUND

A safety helmet is capable of protecting the head of a user from mechanical, chemical and/or thermal environmental effects. Such a safety helmet usually comprises an arched helmet shell made of a hard material, wherein the helmet shell encompasses an area that can be called the interior of the safety helmet. A bearing structure usually holds an inner lining with textile components, wherein the inner lining comes into contact with the head of the user and wherein the bearing structure contributes to the safety helmet being seated in a desired position on the head of the user.

A procedure of installing an arched shock-absorbing shell between the arched helmet shell and the inner lining is known. This shock-absorbing shell is in contact with the helmet shell on the inside and absorbs kinetic energy, which acts on the safety helmet from the outside.

A possibility of attaching this shock-absorbing shell in the safety helmet is to connect the shock-absorbing shell to the interior of the helmet shell by connection in substance, for example, by a bonded connection or by a connection by means of foaming.

A safety helmet (protection helmet 1) with a helmet shell (main outer shell 2), with an inner shell (cap 13) and with a bearing structure (inner helmet shell 11), both arranged in the helmet shell 2, as well as with a chin strap 12, is described in US 2010/0 043 126 A1. The bearing structure 11 is attached at four attaching points 16, 17, 18*a*, 18*b* to the helmet shell 2 in a positive-locking manner. The inner shell 13 is attached to the bearing structure by clipping means.

DE 10 2010 050 678 B3 describes a safety helmet with a hard outer shell 1, with a head band 8 and with a basket-like carrier 11 with a nub array 12. The knob array 12 comprises hollow nubs 13, which point outwards and absorb kinetic energy during a deformation.

SUMMARY

A basic object of the present invention is to provide a safety helmet, wherein the safety helmet comprises a helmet shell and a shock-absorbing shell and wherein the shock-absorbing shell is held in a reliably operating manner in a desired position relative to the helmet shell, without a connection by connection in substance being necessary between the shock-absorbing shell and the helmet shell.

Further, the basic object of the present invention is to provide a process for manufacturing such a safety helmet.

Advantageous embodiments of the safety helmet according to the present invention are, insofar as meaningful, also advantages of the process according to the present invention and vice versa.

The terms "top," "bottom," "front" and "back" will hereinafter be used. These terms pertain to the usual orientations when a user carries the safety helmet on his head and is looking straight forward.

The safety helmet according to the present invention comprises an arched helmet shell, an arched shock-absorbing shell, a holding ring and at least one resilient element, and optionally a plurality of resilient elements. The shock-absorbing shell, the holding ring and the resilient element or each resilient element are located inside in the arched helmet shell. The terms "inside" and "outside" pertain to the space that the arched helmet shell encompasses.

The holding ring is permanently connected to the helmet shell. The holding ring is preferably a complete ring and it entirely encircles the head of a user of the safety helmet.

The shock-absorbing shell adjoins the helmet shell and is configured to absorb kinetic energy, especially kinetic energy that acts on the safety helmet from the outside.

The holding ring has a curved holding ring edge. The shock-absorbing shell has a curved shock-absorbing shell edge. The shock-absorbing shell edge flatly adjoins the holding ring edge (shock-absorbing shell edge adjoins the holding ring edge in an areal manner—areally adjoins). When the safety helmet is located on the head of a user of the safety helmet, the holding ring edge points upward and the shock-absorbing shell edge downward.

At least one resilient element is located between the holding ring edge and the shock-absorbing shell edge. The resilient element is supported at the holding ring, touches the shock-absorbing shell edge and seeks to move the shock-absorbing shell away from the holding ring and to press (bias) the shock-absorbing shell against the helmet shell from the inside. A plurality of resilient elements of the safety helmet preferably possess this property.

The helmet shell protects the user of the safety helmet from a mechanical and/or thermal and/or chemical environmental effect, which acts on the safety helmet from the outside. The shock-absorbing shell is mounted on the helmet shell on the inside, is protected by the helmet shell from environmental effects and absorbs kinetic energy, which acts on the safety helmet from the outside. The helmet shell may be manufactured from a sufficiently solid material, while the shock-absorbing shell may be manufactured from a material that is elastic and/or plastic. Since the shock-absorbing shell is located inside the helmet shell, it does not necessarily need to be able to withstand the mechanical and thermal and chemical environmental effects.

The shock-absorbing shell absorbs kinetic energy, which acts on the helmet from the outside, and it protects thereby the head of the user to a certain extent. In addition, the shock-absorbing shell provides a cushioning between the helmet shell and the head of the user.

The holding ring is connected according to the present invention permanently to the helmet shell. This permanent connection is established at least during a use/an application of the safety helmet. In one embodiment, it is possible to detach the holding ring from the helmet shell when it is not being used, for example, in order to repair or to replace or to clean the holding ring. Thanks to the permanent connection, the holding ring cannot move to an appreciable extent relative to the helmet shell during a use.

As a rule, the shock-absorbing shell shall not change its position relative to the helmet shell at least during a use of the safety helmet. In particular, neither the shock-absorbing shell nor the helmet shell shall slip to and fro on the head of a user. An undesired relative movement could, in addition, bring about a relevant wear and cause undesired noises. It will be described below how and in what manner the present invention contributes to the prevention of these undesired effects.

According to the present invention, the curved shock-absorbing shell edge adjoins the curved holding ring edge. The shock-absorbing shell is located between the holding ring edge and the helmet shell. Since the holding ring is permanently connected to the helmet shell, the holding ring edge does not change its position relative to the helmet shell. Unavoidable relative movements based on tolerances are, of course, exceptions. The holding ring edge therefore limits a possible movement of the shock-absorbing shell away from the helmet shell.

According to the present invention, at least one resilient element is supported at the holding ring, which is permanently connected to the helmet shell. This resilient element touches the shock-absorbing shell edge and seeks to press the shock-absorbing shell away from the holding ring and to press it from the inside against the helmet shell. The safety helmet preferably comprises a plurality of resilient elements configured in this manner, which touch the shock-absorbing shell edge at different points and act together on the shock-absorbing shell and seek to move together towards the helmet shell.

Thanks to the resilient element, it is not necessary to connect the shock-absorbing shell to the holding ring or to the helmet shell. The use of the resilient element or of a plurality of resilient elements instead of a permanent connection makes it easier to find a respective suitable material for the helmet shell, for the holding ring and for the shock-absorbing shell. Since these three components of the safety helmet have different tasks, they are manufactured, as a rule, from different materials, which are well suited for the respective purpose.

At least one resilient element touches according to the present invention the shock-absorbing shell edge and seeks to press the shock-absorbing shell against the helmet shell. As a result, the shock-absorbing shell will be touched at at least one connection point on the shock-absorbing shell edge, and optionally at a plurality of connection points located at mutually spaced locations. It is not necessary for the shock-absorbing shell to be touched flatly along a longer section. The present invention therefore reduces the risk that the shock-absorbing shell would be compressed or stretched during the use of the safety helmet and be worn off or damaged thereby.

Since at least one resilient element presses the shock-absorbing shell against the helmet shell from the inside, it is not necessary to manufacture the holding ring exactly according to a specification and to attach it exactly in a defined position relative to the helmet shell. Broader tolerances are rather possible during the manufacture and the mounting of the holding ring, because the resilient element compensates inaccuracies in the manufacture and assembly of the safety helmet. In particular, the resilient element is capable of expanding to different extents and thereby of pressing the shock-absorbing shell against the helmet shell despite different possible distances. These tolerances notwithstanding, the risk that the shock-absorbing shell would carry out undesired movements relative to the helmet shell is relatively low.

The present invention makes it possible for the shock-absorbing shell not to need to be connected mechanically either to the helmet shell or to the holding ring. This embodiment facilitates the assembly of the safety helmet. In addition, it is easier in many cases thanks to the present invention to remove the shock-absorbing shell from the safety helmet, for example, in order to clean or to replace the shock-absorbing shell. It is sufficient in many cases to compress the resilient element or each shock-absorbing shell resilient element, which presses the shock-absorbing shell against the helmet shell, and then to remove the shock-absorbing shell from the helmet shell, since the shock-absorbing shell is manufactured, as a rule, from a flexible material. In addition, the embodiment in which the shock-absorbing shell is not connected either to the helmet shell or to the holding ring reduces the risk of wear of the shock-absorbing shell. Such a wear may occur in safety helmets according to the state of the art especially at a connection point between the shock-absorbing shell and the holding ring or at an area in which the shock-absorbing shell is connected to the helmet shell by connection in substance.

The present invention eliminates the need to connect the shock-absorbing shell to the helmet shell or to the holding ring by connection in substance. In particular, the need to bond the shock-absorbing shell or to attach it by foaming is eliminated. Since no connection by connection in substance needs to be made, a step in the manufacture of the safety helmet according to the present invention is eliminated, compared to the manufacture of a safety helmet with a connection by connection in substance. In addition, the material for the material needed for the connection by connection in substance is eliminated. As a result, the safety helmet becomes lighter. The need for a solvent for a connection in substance is eliminated as well. Moreover, the need to provide a heat-resistant material for the connection by a connection in substance is eliminated, which is especially important when it shall be possible to use the safety helmet at a high ambient temperature. Since no connection in substance needs to be severed, it is easier to separate the shock-absorbing shell from the safety helmet, for example, in order to clean the shock-absorbing shell or in order to replace it with a new shock-absorbing shell.

At least one resilient element is supported according to the present invention at the holding ring and it seeks to move the shock-absorbing shell away from the holding ring and to press it against the helmet shell. In one embodiment, the resilient element permanently protrudes over the holding ring edge. The resilient element is preferably located between the holding ring edge and the shock-absorbing shell edge. In another embodiment, the shock-absorbing shell presses the resilient element against the spring force into the holding ring, preferably such that the resilient element does not protrude over the holding ring edge. The resilient element presses the shock-absorbing shell against the helmet shell in this embodiment as well.

In one embodiment, the holding ring comprises at least one projection, which points towards the shock-absorbing shell. The shock-absorbing shell comprises for each projection at least one corresponding recess. The projection or each projection of the holding ring engages (meshes) with a respective corresponding recess of the shock-absorbing shell. Conversely, it is possible that the shock-absorbing shell has at least one projection and the holding ring has at least one corresponding recess. It is also possible that both the shock-absorbing shell and the holding ring have a projection each and a corresponding recess each. This embodiment with the projection and with the recess limits a possible movement of the shock-absorbing shell relative to the helmet shell in at least one direction and it further reduces the risk of the shock-absorbing shell performing an undesired movement relative to the helmet shell.

The projection or at least one projection of the holding ring is preferably located between the helmet shell and the shock-absorbing shell. This projection is well protected hereby from mechanical damage.

In one embodiment, the shock-absorbing shell has at least one projection. This projection points towards the helmet shell. The helmet shell has at least one corresponding stop element, which points towards the shock-absorbing shell. As an alternative, the helmet shell comprises a projection, which points towards the shock-absorbing shell. The shock-absorbing shell has a corresponding stop element, which points towards the helmet shell. In both embodiments, the projection and the stop element together limit a movement of the shock-absorbing shell relative to the helmet shell in one direction, namely when the projection abuts against the stop element. This direction is preferably the viewing direction of a user of the safety helmet looking forward.

The outer profile of the arched shock-absorbing shell is preferably identical to the inner profile of the arched helmet shell, which profile points towards the shock-absorbing shell, either completely or at least in some areas. This configuration with the two identical profiles contributes to the shock-absorbing shell being held in a desired position relative to the helmet shell. A possible movement of the shock-absorbing shell relative to the helmet shell is limited hereby to a tangential movement along the arched inner surface of the helmet shell, at least when the safety helmet is located on the head of a user.

In one embodiment, the holding ring edge extends in a plane. The holding ring edge has an area that protrudes from this holding ring plane, for example, an area that extends in an area plane, the area plane being in an oblique position relative to the holding ring plane. This protruding area of the holding ring edge adjoins an area of the shock-absorbing shell edge. The profiles of the holding ring edge and of the shock-absorbing shell edge correspond to one another at least in these two adjoining areas. A possible movement of the shock-absorbing shell relative to the helmet shell is limited in at least one direction by this embodiment as well. This direction is the viewing direction of the user of the safety helmet, who is looking forward.

In one embodiment, the shock-absorbing shell has an oblong projection, which is arched outwards, i.e., towards the helmet shell. The helmet shell has a corresponding groove. The oblong projection of the shock-absorbing shell engages with the groove of the helmet shell. This configuration limits the possible movement that the shock-absorbing shell can perform relative to the helmet shell in a direction at right angles or obliquely to the common longitudinal axis of the projection and of the groove. This common longitudinal axis preferably extends in parallel to the viewing direction of the user of the safety helmet.

In one embodiment, the shock-absorbing shell edge touches the holding ring edge, at least along a part of its extension, i.e., optionally along its entire extension, i.e., along a full circumference. In one embodiment, the shock-absorbing shell edge has a distance from the holding ring edge at least along a part of its extension. It is also possible that the shock-absorbing shell edge has a distance from the holding ring edge along its entire extension, i.e., along a full circumference. The distance between the shock-absorbing shell edge and the holding ring edge may remain constant along these edges or change in space. The resilient element or each resilient element, which is supported at the holding ring, bridges over this distance.

In a preferred embodiment, the shock-absorbing shell is not connected mechanically to the helmet shell, in particular, not by connection in substance. The shock-absorbing shell is not, in addition, preferably connected mechanically to the holding ring. In another embodiment, the shock-absorbing shell is connected mechanically to the holding ring at at least one connection point, the connection preferably being a detachable connection.

The holding ring preferably encompasses the entire head of a user of the safety helmet. A distance preferably develops between the holding ring and the head of the user, this distance depending on the size and the shape of the head. Thanks, in particular, to this distance, the same safety helmet according to the present invention or a plurality of safety helmets according to the present invention of an identical configuration can be used by users with heads of different sizes. In addition, the same user can optionally use the same safety helmet with or without a head cover. It is not necessary to adapt the holding ring to the shape of the head.

The safety helmet comprises according to the present invention a holding ring, which is permanently connected to the helmet shell. The safety helmet preferably comprises additionally a bearing ring, which is likewise located in the area that is enclosed by the arched helmet shell. This bearing ring encompasses the head of a user of the safety helmet. The bearing ring is in contact with the head of the user at least in some areas. A padding or another textile sheathing may be arranged between the bearing ring and the head of the user. This textile sheathing can preferably be removed from the safety helmet and cleaned separately from the rest of the safety helmet.

A distance develops between the holding ring and the bearing ring. This distance depends, as a rule, on the size and/or the shape of the head of a user. The bearing ring may be manufactured from a flexible material in order to be adapted to the shape of the head of the user. The length of the bearing ring can preferably be changed, so that the head size, which the safety helmet provides, can be changed as well.

This embodiment consequently provides, on the one hand, for a holding ring, which contributes to the shock-absorbing shell being held in a desired position relative to the helmet shell and for the helmet shell to be held in a desired position relative to the head. In addition, the holding ring may contribute to the holding of an optional inner lining. On the other hand, this embodiment provides for a bearing ring, which contributes to the safety helmet being seated firmly on the head of a user and to the safety helmet being able to be adapted to the size and the shape of the head of the user.

A preferred process for manufacturing a safety helmet according to the present invention comprises the following steps:

- The helmet shell, the holding ring, the shock-absorbing shell and the resilient element or each resilient element are provided. These components may be manufactured at different locations and each from a material that is well suited for the respective component.
- The resilient element or each resilient element is attached to the holding ring such that it is supported at the holding ring and projects over the holding ring edge at least in the relaxed state.

The shock-absorbing shell is inserted into the helmet shell on the inside. It is possible but not necessary thanks to the present invention to attach the shock-absorbing shell to the helmet shell.

The holding ring is then inserted into the helmet shell. The resilient element or each resilient element, which projects over the holding ring edge, presses after the insertion the already inserted shock-absorbing shell against the helmet shell. The holding ring is optionally held temporarily in this position by a human being or by an automatic handling device until the holding ring is attached to the helmet shell.

The holding ring is permanently connected to the helmet shell. After this permanent connection, the resilient element or each resilient element at the holding ring presses the shock-absorbing shell against the helmet shell.

This manufacturing process makes it easier to insert the shock-absorbing shell into the helmet shell from the inside and to displace it when needed, so that the shock-absorbing shell assumes a desired position relative to the helmet shell. If the inner profile of the helmet shell and the outer profile of the shock-absorbing shell are identical, it is possible relatively easily to insert the shock-absorbing shell into the helmet shell such that no hollow space will develop between the helmet shell and the shock-absorbing shell. The shock-absorbing shell is preferably inserted into the helmet shell before the holding ring as well as an optional bearing ring and an optional inner lining are connected to the helmet shell. As a result, neither the holding ring nor the bearing ring nor the inner lining will impair the process of inserting the shock-absorbing shell into the helmet shell and of positioning same correctly.

The safety helmet can again be taken apart by a sequence of operations carried out in the reverse order in order to inspect or repair it or in order to replace a damaged component. The present invention makes it easier to remove the holding ring or the bearing ring without having to separate a connection to the shock-absorbing shell.

In one embodiment, at least the shock-absorbing shell, the holding ring and the resilient element or each resilient element of a safety helmet according to the present invention are produced by at least one 3D printer. Different components of the safety helmet are optionally produced by different 3D printers, also at different locations. The helmet shell is also produced in one embodiment by a 3D printer, and it is produced by another manufacturing process in another embodiment. The components are preferably assembled into a safety helmet according to the present invention.

The present invention pertains, on the one hand, to a 3D printer, which is configured to produce the just mentioned components of a safety helmet according to the present invention. In a variant, an arrangement with a plurality of 3D printers together is capable of producing the components just mentioned. On the other hand, the present invention pertains to a computer program, which can be executed on a computer. If the computer program is executed on the computer, the computer actuates at least one 3D printer. The actuated 3D printer produces the just mentioned components of the safety helmet according to the present invention. The computer optionally actuates a plurality of 3D printers for different components. It is also possible that different computer programs actuate a respective computer each, and each actuated computer produces at least one component each of the safety helmet according to the present invention.

The present invention will be described below on the basis of an exemplary embodiment. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
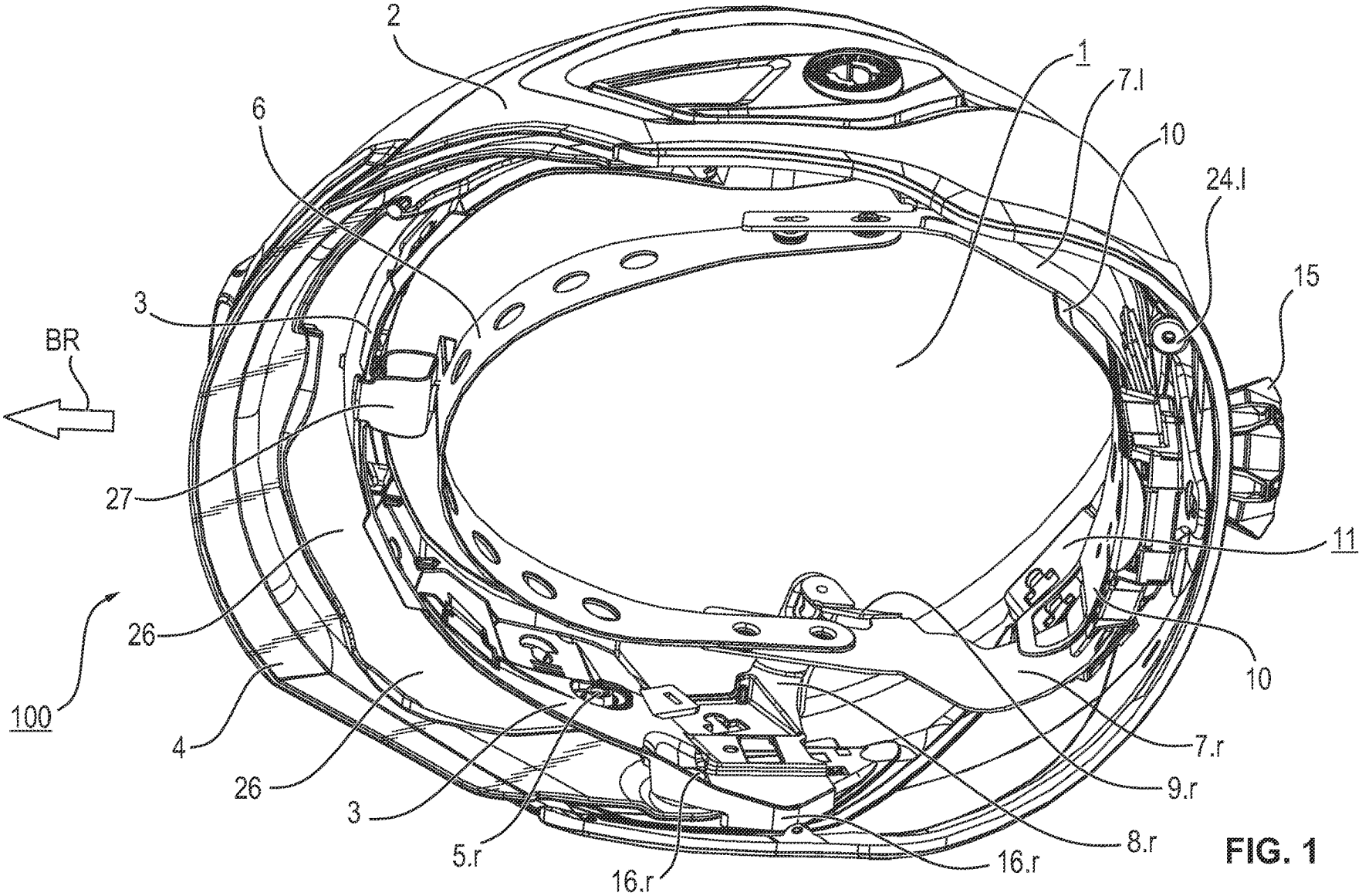
FIG. 1 is a perspective view showing the safety helmet from an oblique direction from below and from the side.

Referring to the drawings, the present invention pertains to a safety helmet, which is used by firefighters, police, rescue workers and other rescue team members in order better to protect the head from mechanical, thermal and chemical effects.

The safety helmet according to the exemplary embodiment comprises - like many other safety helmets - an arched helmet shell made of a hard material, an arched shock-absorbing shell, a bearing structure and an inner lining. The inner lining is in contact with the head of a person, who is wearing this safety helmet on his head. This person will hereinafter be called "the user." The bearing structure connects the inner lining to the helmet shell and is attached on the inside to the helmet shell. The inner lining is omitted in the figures.

The terms "front," "rear," "left," "right," "top" and "bottom" used below refer to the usual orientation when the user wears the safety helmet and is looking forward. The viewing direction BR of the user looking straight forward is shown in some figures.

The shock-absorbing shell is in contact on the inside with the helmet shell, it absorbs kinetic energy acting from the outside on the safety helmet and pads the safety helmet. The shock-absorbing shell shall be seated on the inside in the helmet shell without a major clearance. The present invention shows a way of achieving this effect without a connection by connection in substance having to be established between the helmet shell and the shock-absorbing shell, especially without a bonded connection and without a Velcro® connection.

Figure 2:
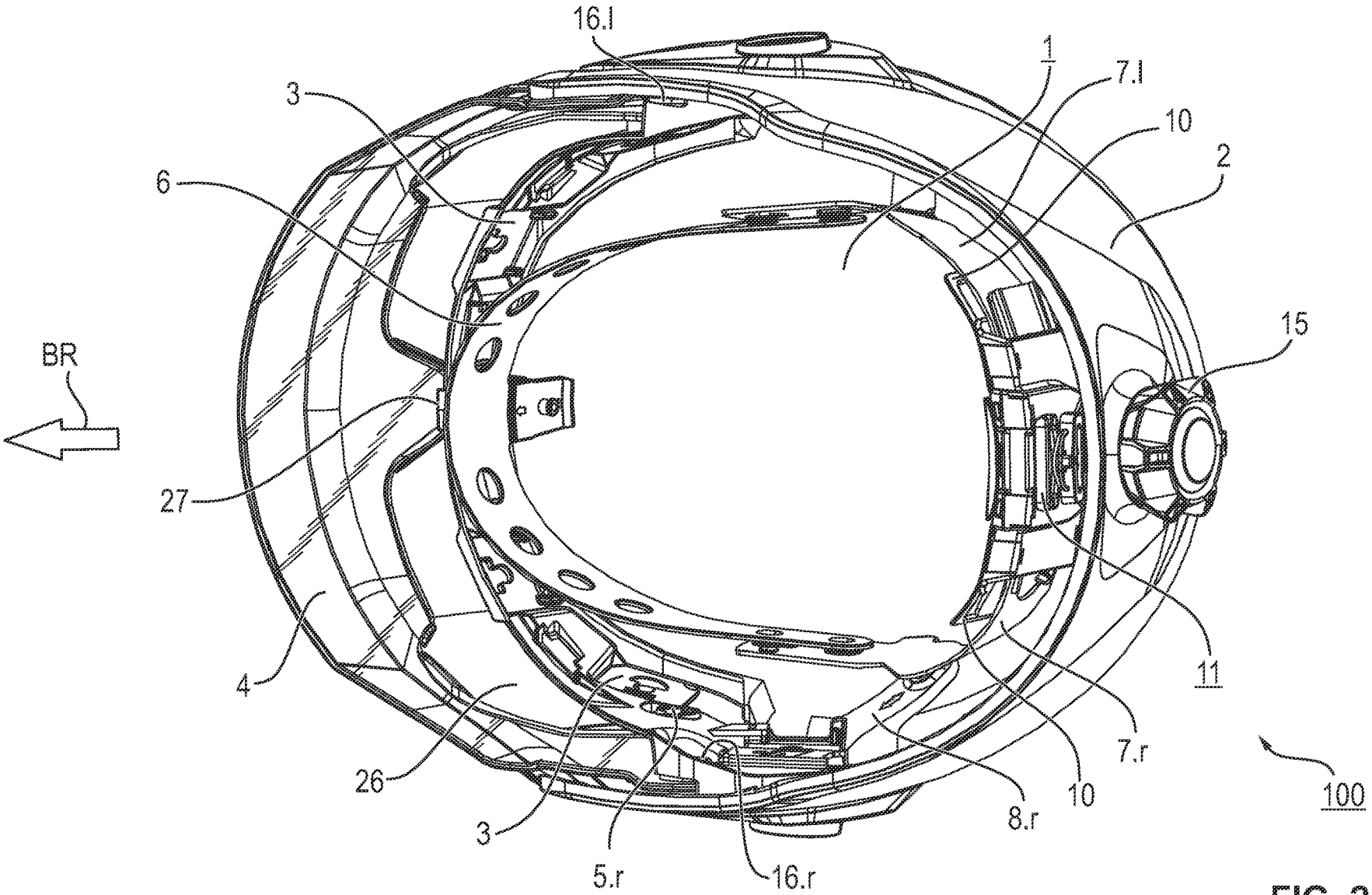
FIG. 2 is a perspective view showing the safety helmet from an oblique direction from below and from the rear.
Figure 3:
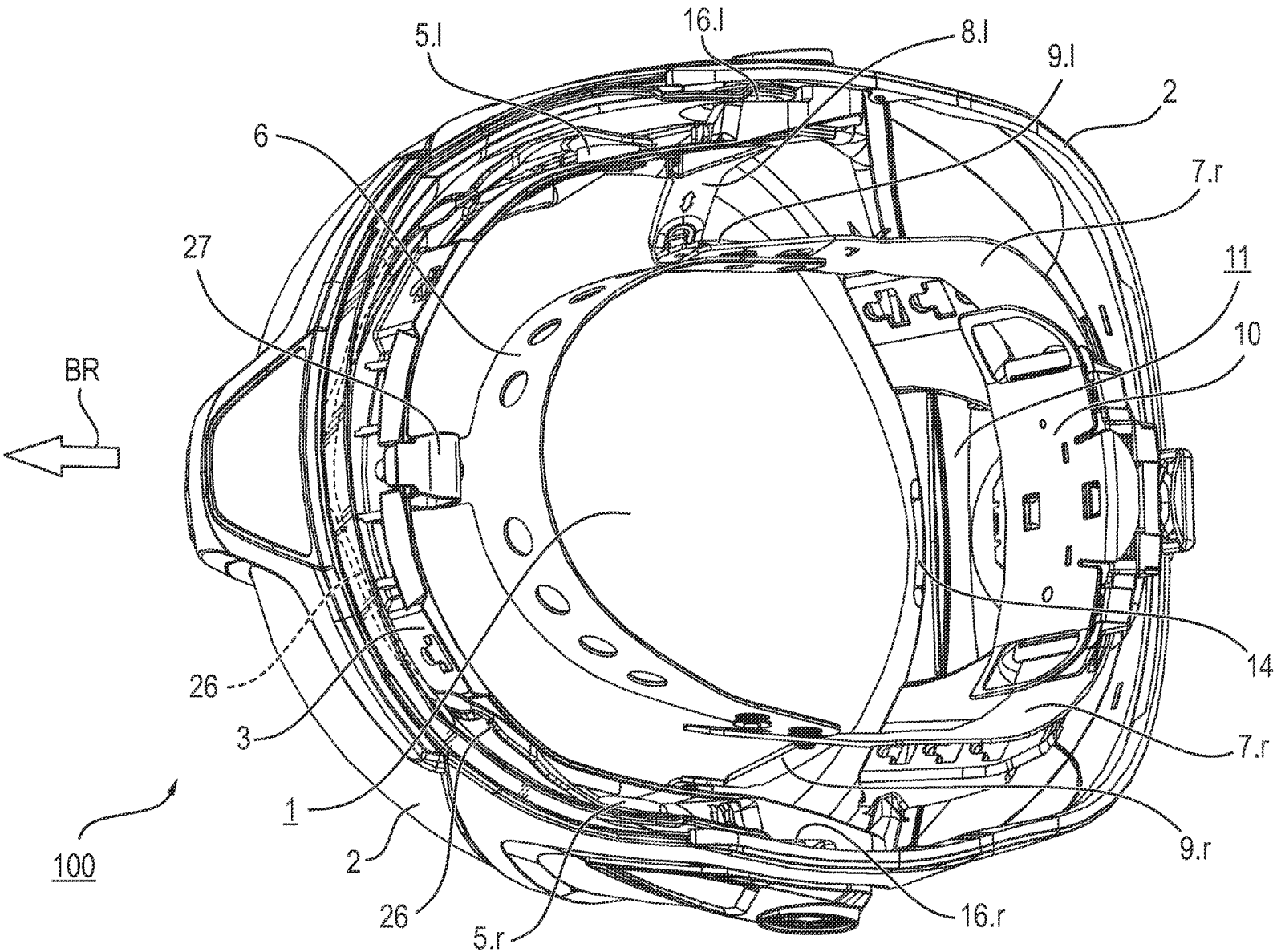
FIG. 3 is a perspective view showing the safety helmet from an oblique direction from below and from the front.

FIG. 1, FIG. 2 and FIG. 3 show a safety helmet 100, which has the following components, from different viewing directions:

- an arched helmet shell 2 made of a hard material,
- an arched shock-absorbing shell 1, which is inserted on the inside into the helmet shell 2,
- a pivotable visor 4,
- a front holding ring part 3, which is detachably connected from the inside to the helmet shell 2,
- an additional visor in the form of sunglasses 26, which is arranged between the front holding ring part 3 and the helmet shell 2,
- a left screw connection 16.1 and a right screw connection **16.*r* in order to detachably connect the front holding ring part 2 to a respective functional plate on the outside at the helmet shell 2, wherein the two screw connections 16.1 and 16.*r* additionally hold the visor 4 pivotably at the helmet shell 2**,
- a left screw connection 5.1 and a right screw connection **5.*r*, which hold the additional visor 26 at the front holding ring part 3**,
- a front bearing ring part 6, which is in contact with the forehead of the user and is detachably connected to the front holding ring part 3,
- a two-part rear bearing ring part 7 with a left rear part 7.1 and with a right rear part **7.*r***, which is in contact with the back of the head of the user,
- a central rear bearing ring part 10 in the form of a bearing support for the back of the head, which bearing support is likewise in contact with the back of the head of the user and is connected to the two parts 7.1 and **7.*r* of the rear bearing ring part 7** by a respective snap-in connection,
- a left holding arm 8.1 and a right holding arm **8.*r* at the front holding ring part 3**,
- a left holding arm 9.1 at the left part 7.1 of the rear bearing ring part 7,
- a right holding arm **9.*r* at the right part 7.*r* of the rear bearing ring part 7**,
- a snap-in connection between the two left holding arms 8.1, 9.1, and
- a snap-in connection between the two right holding arms **8.*r*, 9.*r***.

The indices 0.1 and .r designate a left part and a right part, respectively.

The safety helmet 100 additionally comprises an inner lining with textile components, which come into contact with the scalp of a user. This inner lining is omitted in the figures.

The outer profile of the safety helmet 1 is adapted to the inner profile of the helmet shell 2.

The bearing ring parts 6, 7, 10 form a curved and annular bearing ring, which fully encircles the head of the user and can be adapted to the shape of the head of the user. The holding ring parts 3, 11 are connected permanently to the helmet shell 2 on the inside. A distance develops in one embodiment between the holding ring part 3 and the bearing ring part 6. An optional, permanent intermediate piece 27 bridges over this distance. In another embodiment, the bearing ring part 6 is attached directly, i.e., without an intermediate piece 27, to the holding ring part 3.

This bearing ring part 6, 7, 10 shall be seated, on the one hand, so firmly on the head of the user that the safety helmet 100 will not slip relative to the head, and, on the other hand, it shall not press the head of the user too strongly. The user can therefore change the length of the bearing ring 6, 7, 10 and hence the head size of the safety helmet 100 manually, doing so by means of a handwheel 15 in the rear at the safety helmet 100. A rotation of the handwheel 15 causes the two parts 7.1 and **7.*r*** to be moved synchronously away from one another or synchronously toward one another.

Figure 4:
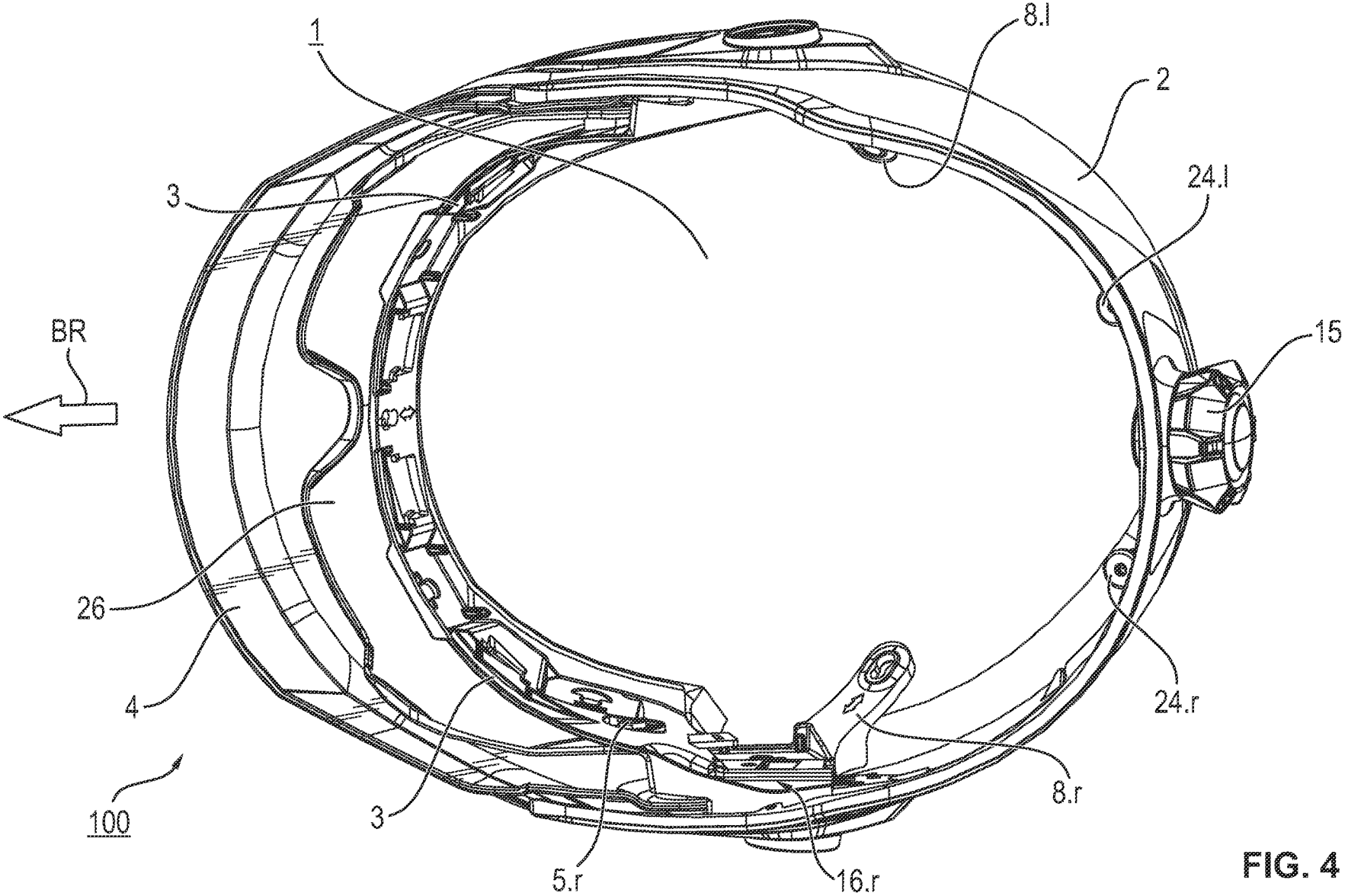
FIG. 4 is a perspective view showing the safety helmet from the viewing direction shown in FIG. 2, wherein the bearing rings are omitted.
Figure 5:
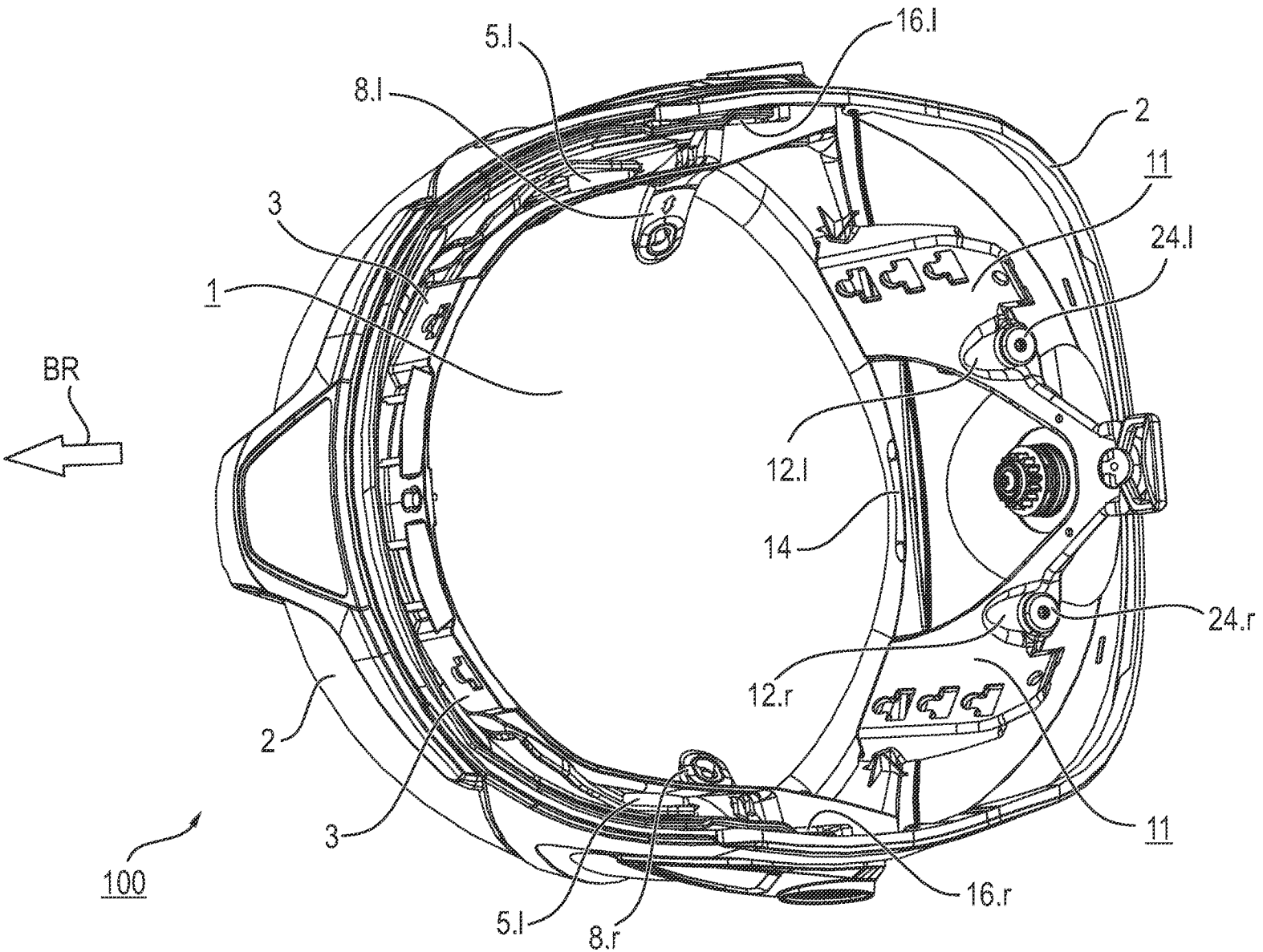
FIG. 5 is a perspective view showing the safety helmet from the viewing direction shown in FIG. 3, wherein the bearing rings and additionally the additional visor are omitted.

The bearing ring parts 6, 7 and 10 as well as the brackets for these are omitted in FIG. 4 and FIG. 5. As a result, a central rear holding ring part 11 will become fully visible, and the rear holding ring part 11 is arranged between the rear bearing rings 7 and 10 and the helmet shell 2 and is detachably connected to the helmet shell 2 and its outer profile is adapted to the inner profile of the helmet shell 2. The rear holding ring part 11 is preferably elastic in itself and presses the helmet shell 2 from the inside based on its own elasticity. The rear holding ring part 11 comprises two through holes 12.1, **12.*r*, through which the two screws 24.1, 24.*r* are passed. These screws 24.1, 24.*r* are screwed into two screw threads 25.1, 25.*r* on the inside in the helmet shell 2 and hold the rear holding ring part 11 from the inside at the helmet shell 2. A preferably resilient and preferably centrally arranged projection 14 presses the shock-absorbing shell 1 from below and presses hereby the shock-absorbing shell 1 upward against the helmet shell 2**. This projection belongs to a resilient element in the sense of the claims.

Figure 6:
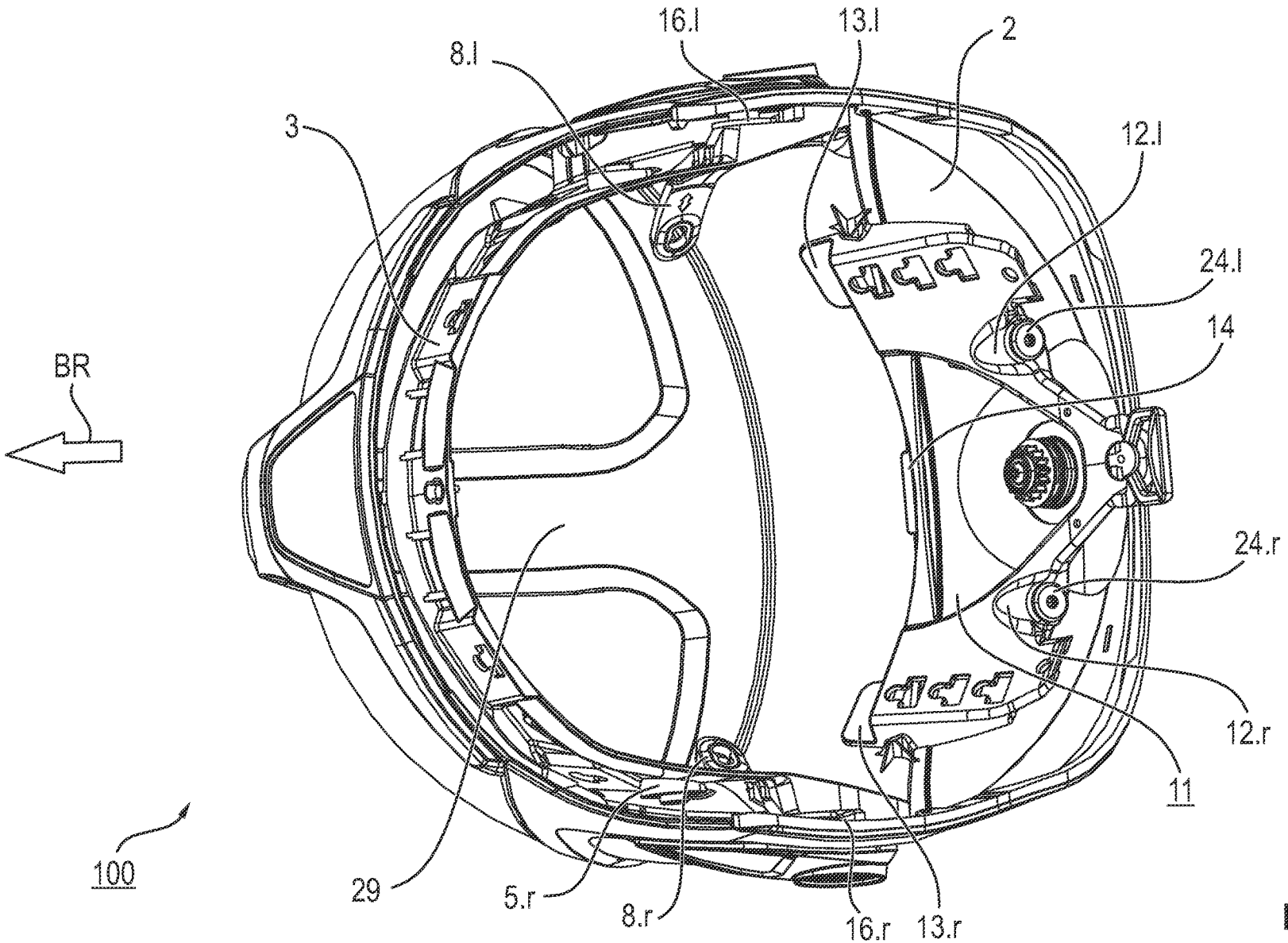
FIG. 6 is a perspective view showing the safety helmet from FIG. 5, wherein the shock-absorbing shell is additionally omitted.

In the perspective view shown in FIG. 6, the additional visor 26 and additionally the shock-absorbing shell 1 are omitted. Two lateral projections 13.1, **13.*r* are seen at the top at the rear holding ring part 11. These projections 13.1, 13.*r* are in contact with the helmet shell 2 from the inside and are located between the helmet shell 2 and the shock-absorbing shell 1. The shock-absorbing shell 1 has a downwards pointing edge. A considerable part of a front area of this edge lies at the top on the front holding ring part 3, and a rear area of this edge lies on the projection 14. The two projections 13.1, 13.*r* extend from the outside towards the shock-absorbing shell 1. As a result, the shock-absorbing shell 1 is held in its position relative to the helmet shell 2** without a connection by connection in substance being necessary. In particular, no bonded connection and no Velcro® connection are needed.

Figure 7:
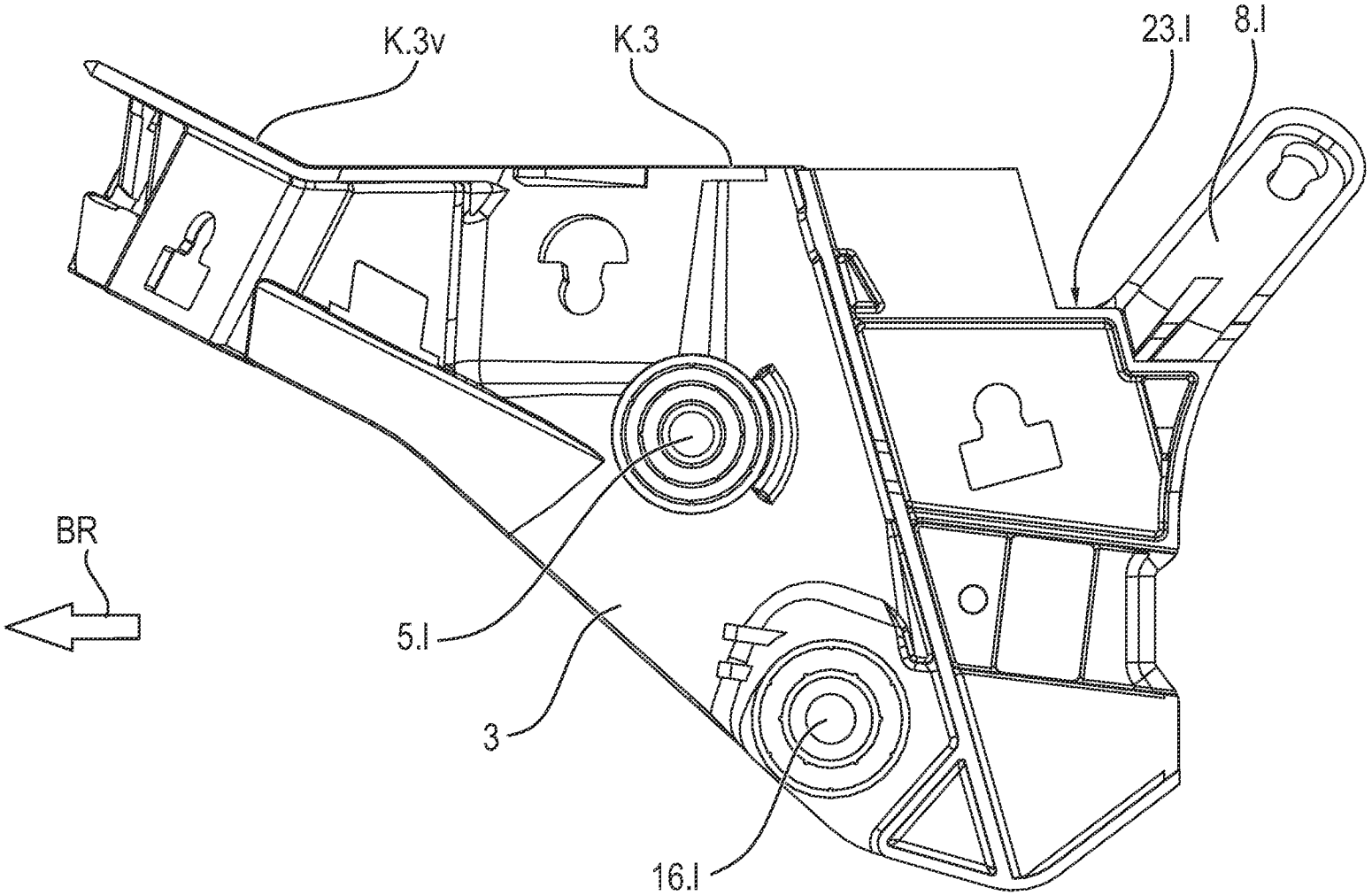
FIG. 7 is a side view showing the front holding ring part.

FIG. 7 shows in a side view from the left the front holding ring part 3, which has, when viewed from the top, the shape of half of an ellipse. A front holding ring edge K.3, which points upwards and has an obliquely rising front part K.**3*v*, can be seen. The front holding ring edge K.3 extends in a plane that is at right angles to the drawing plane of FIG. 7. The front part K.3*v* protrudes from this plane. The front part K.3*v* extends in the exemplary embodiment in another plane, which has an oblique orientation on the plane of the front holding ring edge K.3. This other plane is likewise at right angles to the drawing plane of FIG. 7**.

Figure 8:
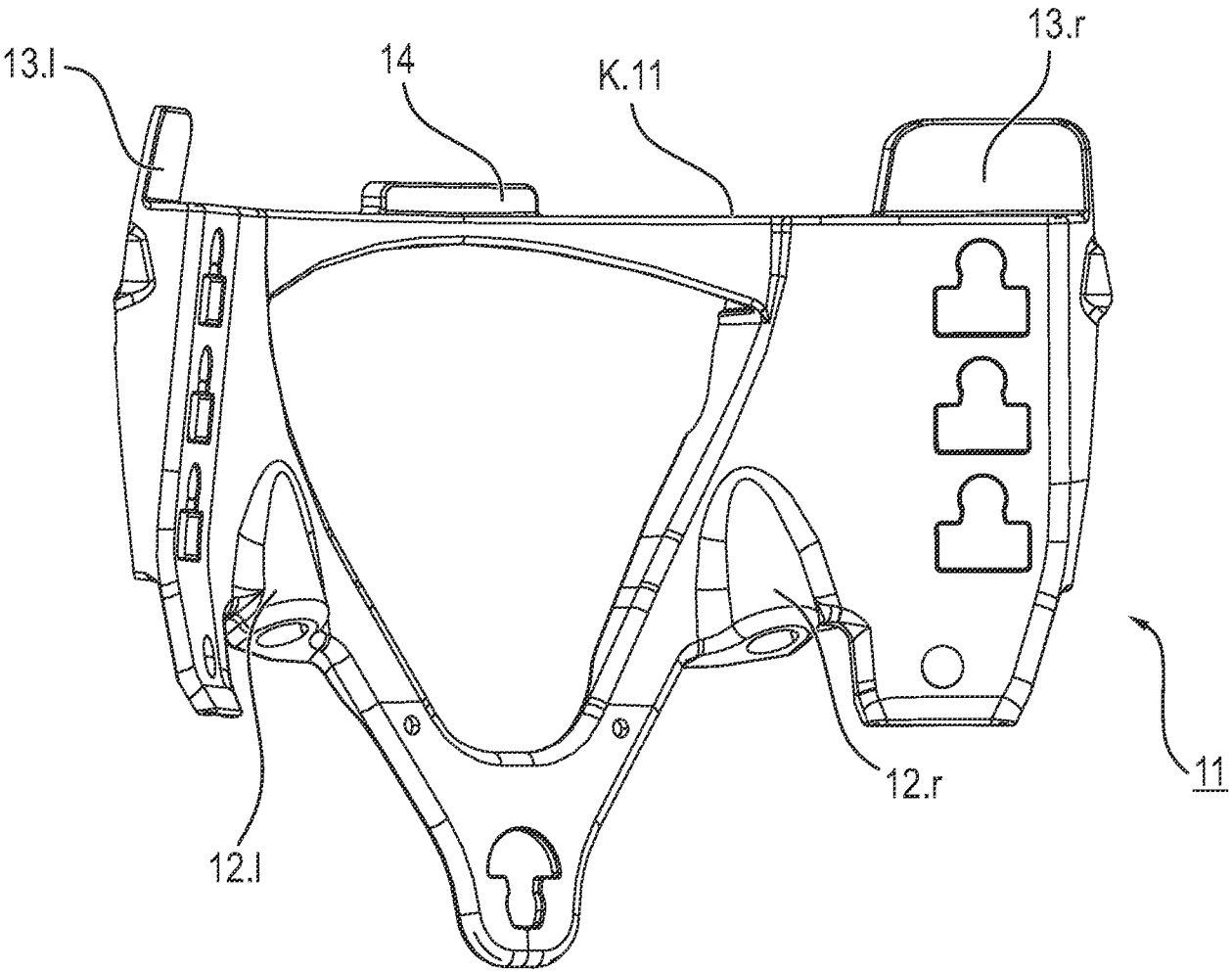
FIG. 8 is a perspective view showing the rear holding ring part from a first viewing direction.
Figure 9:
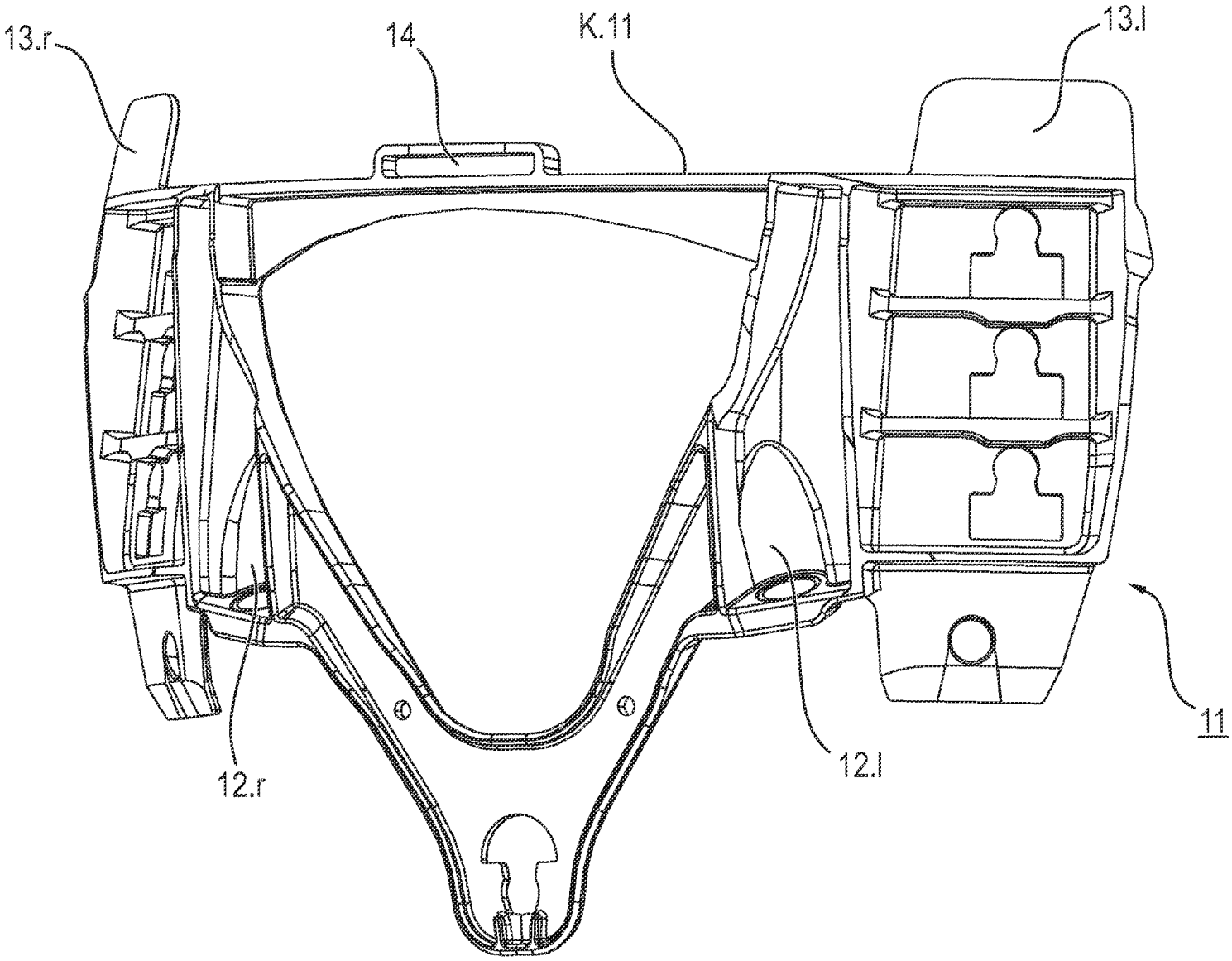
FIG. 9 is a perspective view showing the rear holding ring part from FIG. 8 from a second viewing direction.

FIG. 8 and FIG. 9 show in perspective views the rear holding ring part 11 from two different viewing directions, namely, once from the front (FIG. 8) and once from the rear (FIG. 9). An upwards pointing, rear holding ring edge K.11, which belongs to the rear holding ring part 11, can be seen. The front holding ring edge K.3 and the rear holding ring edge K.11 form together a curved holding ring edge. This curved holding ring edge K.3, K.11 points upwards in case of a usual application.

Figure 10:
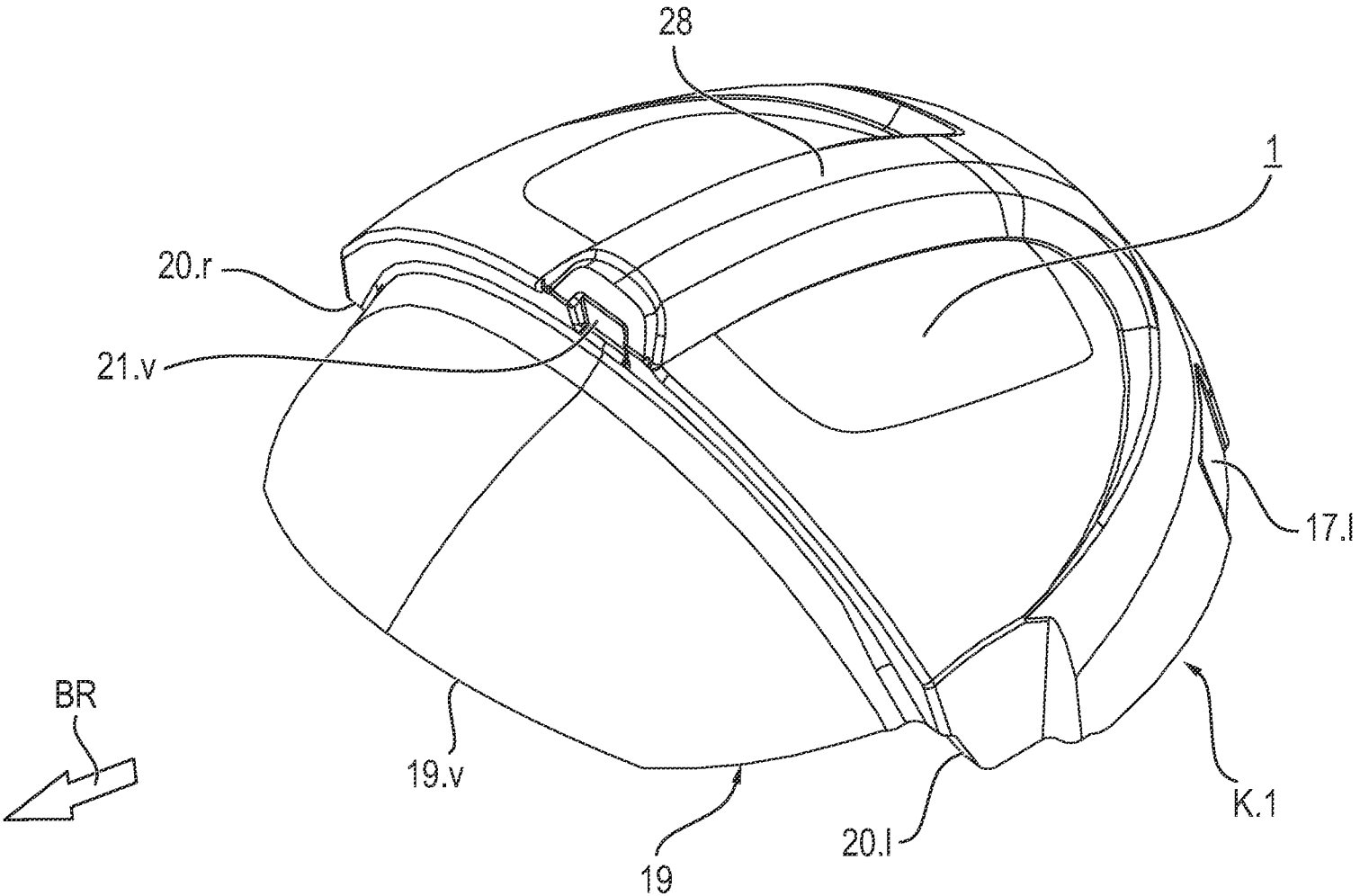
FIG. 10 is a perspective view showing a first embodiment of the shock-absorbing shell from the left in an oblique direction from the top.
Figure 11:
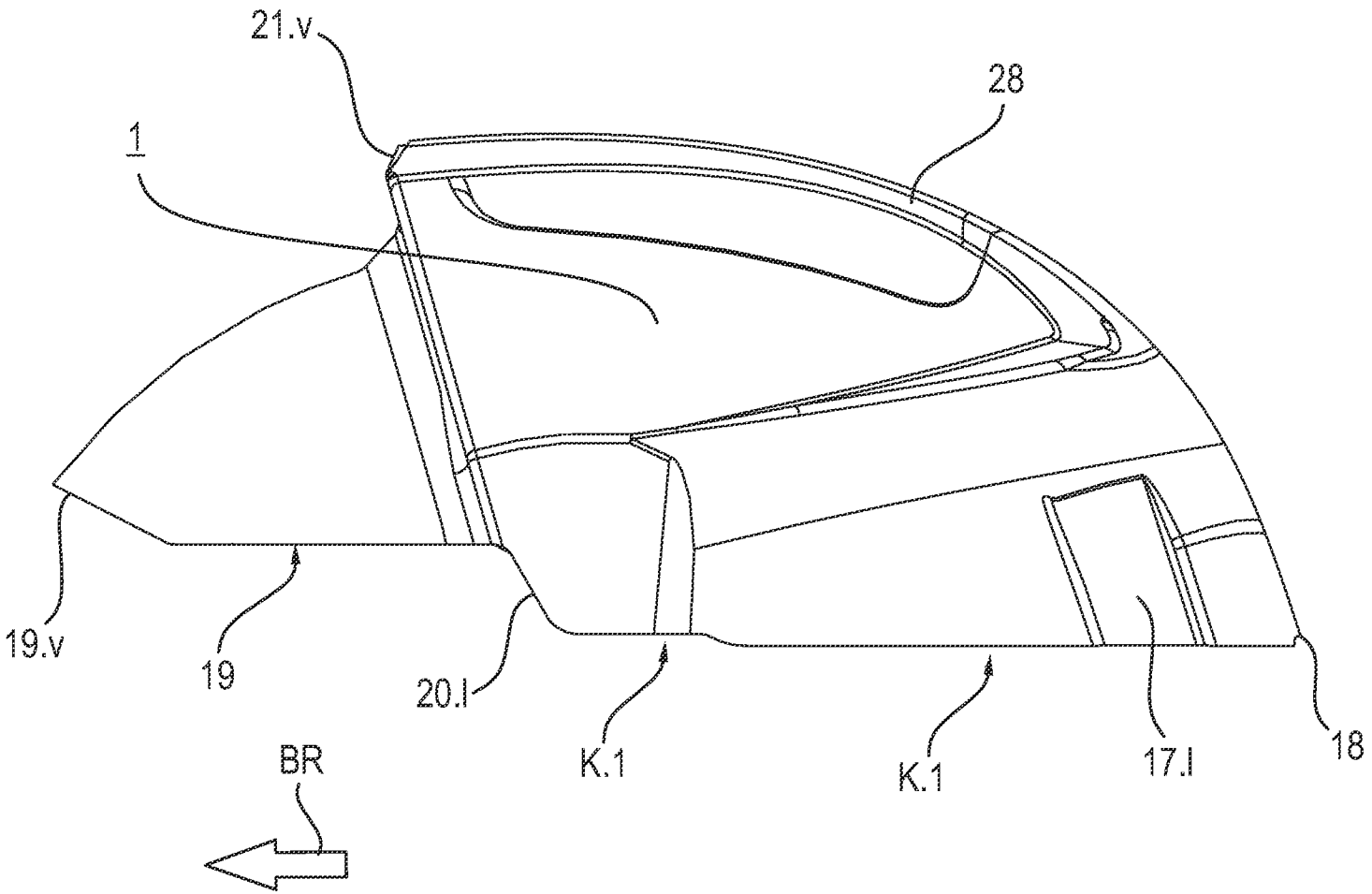
FIG. 11 is a side view showing the shock-absorbing shell from FIG. 10.
Figure 12:
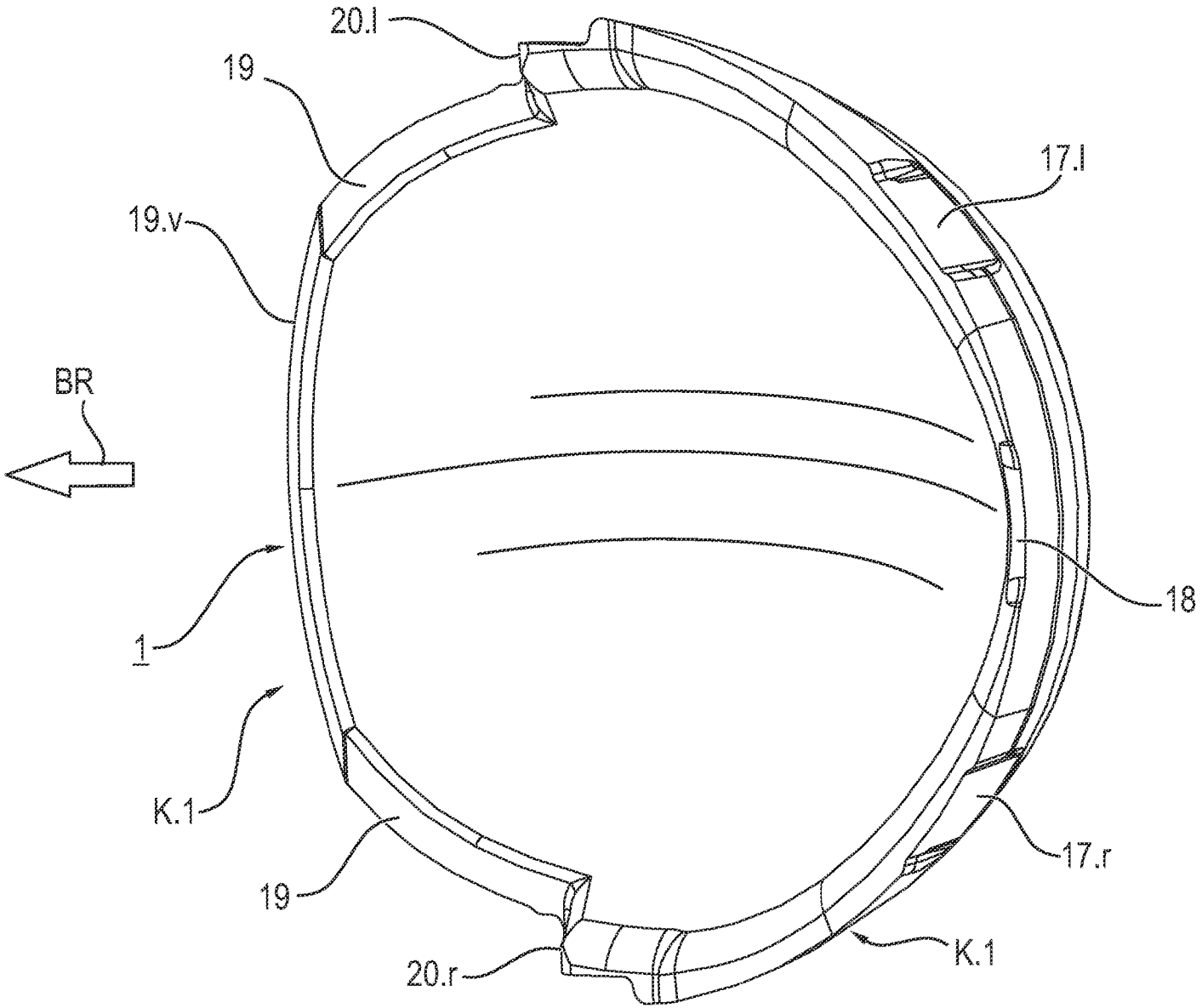
FIG. 12 is a perspective view showing a second embodiment of the shock-absorbing shell from the inside.
Figure 13:
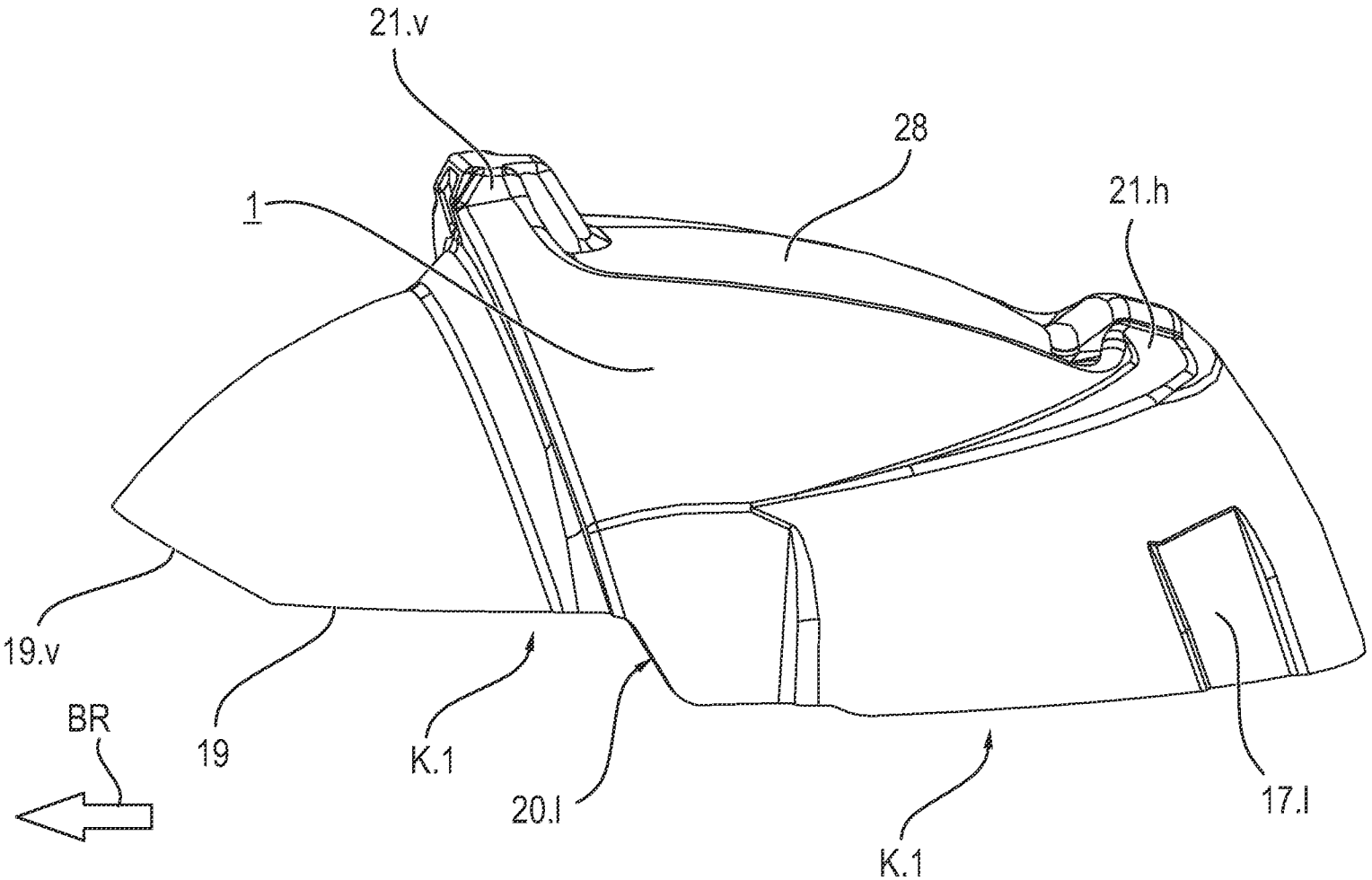
FIG. 13 is a side view showing the shock-absorbing shell from FIG. 12.

FIG. 10 and FIG. 11 show in two perspective views a first embodiment of the shock-absorbing shell 1. FIG. 12 and FIG. 13 show in two perspective views a second embodiment of the shock-absorbing shell 1. A shock-absorbing shell edge K.1, namely, one from the left (FIG. 11), from the inside (FIG. 12), and one on the left from the side (FIG. 13), can be seen. During a usual use of the safety helmet 100, this shock-absorbing shell edge K.1 points downward. When the shock-absorbing shell 1, the front holding ring part 3 and the rear holding ring part 11 are arranged in the interior of the helmet shell 7, the downwards pointing shock-absorbing shell edge K.1 of the shock-absorbing shell 1 is seated on the upwards pointing, front holding ring edge K.3 and on the upwards pointing, rear holding ring edge K.11. Furthermore, the following components of the shock-absorbing shell 1 can be seen:

- two laterally arranged recesses 17.1, 17.*r* at the downwards pointing shock-absorbing shell edge K.1, with which the two laterally arranged projections 13.1, 13.*r* at the rear holding ring part 11 engage,
- a centrally arranged recess 18 at the shock-absorbing shell edge K.1, with which the centrally arranged, resilient projection 14 at the rear holding ring part 11 engages,
- a front edge area 19 of the shock-absorbing shell edge K.1, which area lies on the front holding ring edge K.3,
- an obliquely rising segment 19.*v* of the front edge area 19, wherein the segment 19.*v* lies on the obliquely rising area K.3*v* of the front holding ring edge K.3,
- a centrally arranged, oblong projection 28, and
- two serrated edges 20.1, 20.*r*.

The helmet shell 2 comprises a centrally arranged groove 29. The oblong projection 28 engages with the groove 29.

The second embodiment according to FIG. 12 and FIG. 13 additionally comprises

- a front, centrally arranged projection 21.*v* and
- a rear, centrally arranged projection 21.*h*.

In one embodiment, a distance is formed between the two serrated edges 20.1, 20.*r* and two corresponding serrated areas 23.1, 23.*r* of the front holding ring edge K.3 during regular use. The front edge area 19 moves under a higher load in the direction of the front holding ring edge K.3. The two serrated edges 20.1, 20.*r* lie temporarily on the serrated areas 23.1, 23.*r* in case of a very high mechanical load only. As a result, forces are diverted. In another embodiment, the two serrated edges 20.1, 20.*r* lie permanently on the serrated areas 23.1, 23.*r*.

Figure 14:
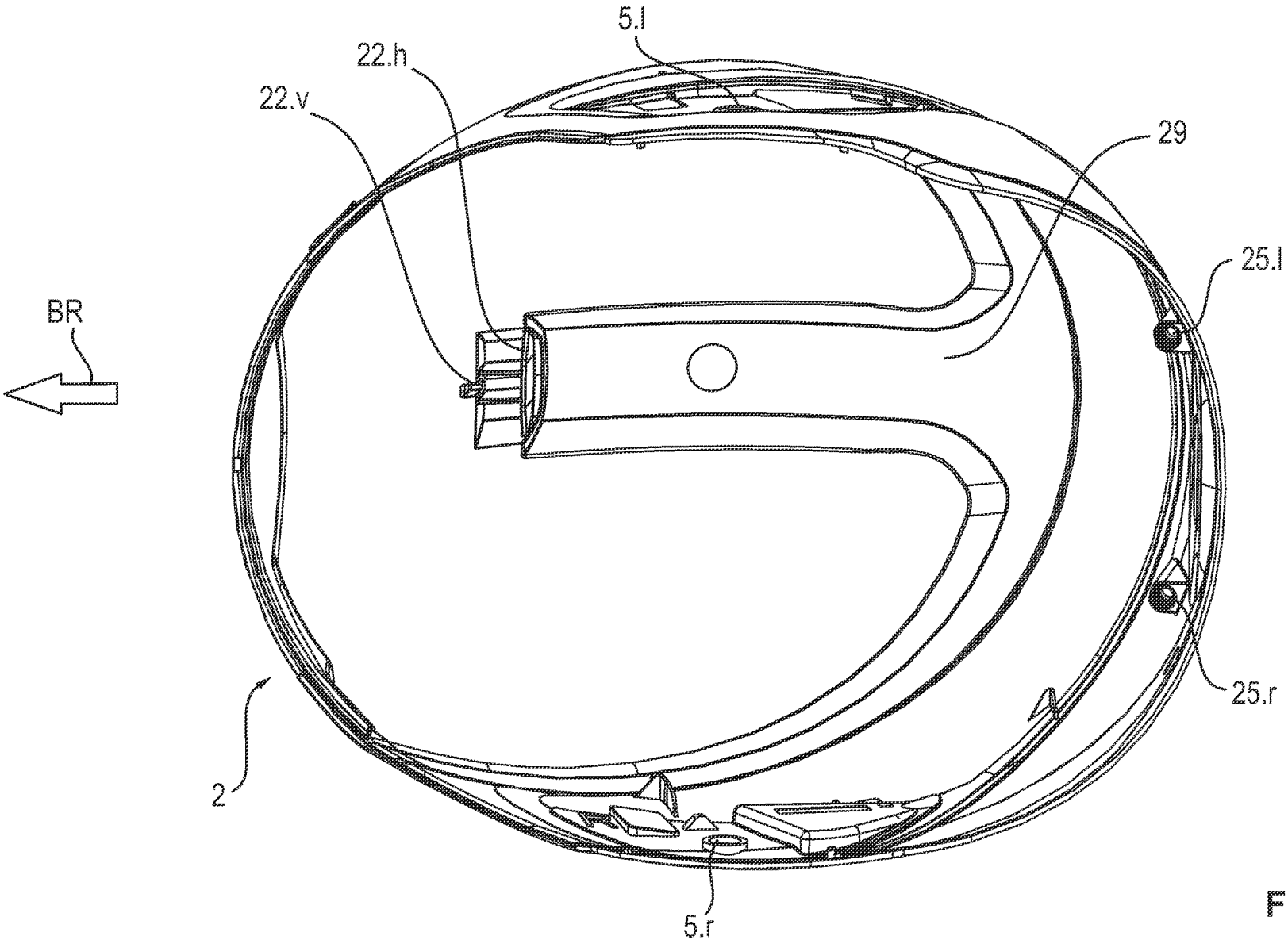
FIG. 14 is a perspective view showing the helmet shell from the inside from a first viewing direction.
Figure 15:
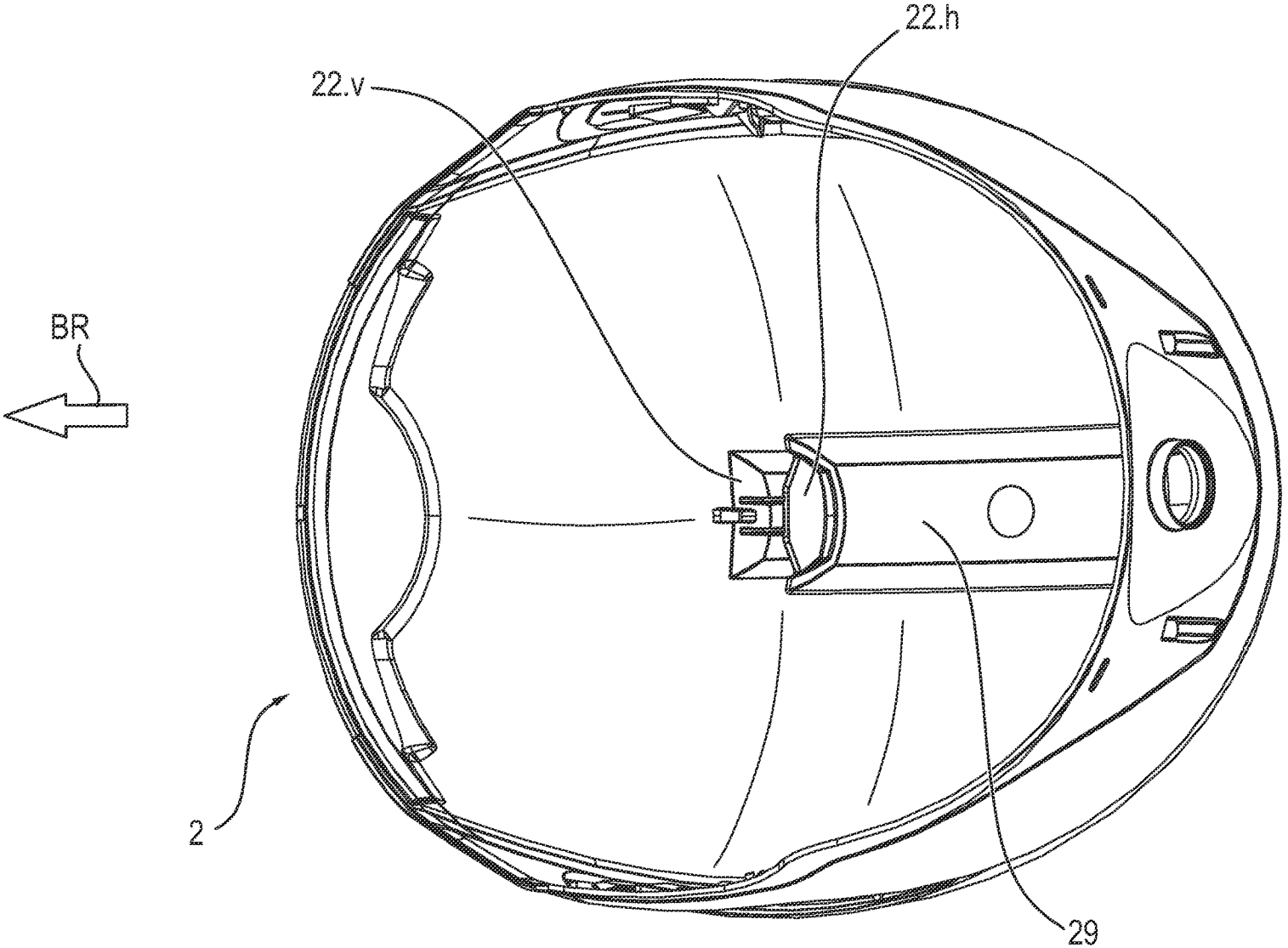
FIG. 15 is a perspective view showing the helmet shell from the inside from a second viewing direction.

FIG. 14 and FIG. 15 show from the inside an embodiment of the helmet shell 2, which matches the second embodiment of the shock-absorbing shell 1 (FIG. 12 and FIG. 13) and may also be used together with the first embodiment (FIG. 10 and FIG. 11). Two projections 22.*v*, 22.*h* arranged centrally one behind another can be seen. The centrally arranged projection 21.*v* at the top on the shock-absorbing shell 1 engages in one embodiment with the space between these two projections 22.*v*, 22.*h* on the inside at the stop element for the projection 21.*v*. In conjunction with the projection 21.*v*, these stop elements 22.*v*, 22.*h* limit a possible movement of the shock-absorbing shell 1 relative to the helmet shell 2 in the viewing direction BR and opposite the viewing direction BR.

In another embodiment, the projection 21.*v* of the shock-absorbing shell 1 is in contact with the rear projection 22.*h* of the helmet shell 2. The projection 22.*v* belongs to a snap-in connection for the visor 7.

The rear projection 21.*h* at the top on the shock-absorbing shell 1 engages with an outwards pointing and centrally arranged groove 29 in the rear area of the helmet shell 2. As a result, the projection 21.*h* prevents a movement of the shock-absorbing shell 1 relative to the helmet shell 2 at right angles or obliquely to the viewing direction BR.

In an alternative embodiment, the helmet shell 2 matches the first embodiment of the shock-absorbing shell 1 (FIG. 10 and FIG. 11). The helmet shell 2 according to this alternative embodiment does not preferably have the two projections 22.*v*, 22.*h*, which are shown in FIG. 14 and FIG. 15.

The two serrated areas 20.1, 20.*r* of the shock-absorbing shell edge K.1 can be moved in the viewing direction BR up to the serrated areas 23.1, 23.*r* of the front holding ring edge K.3 of the front holding ring part 3. As a result, the serrated areas 23.1, 23.*r* form two stop elements, which limit a movement of the shock-absorbing shell 1 relative to the helmet shell 2 in the viewing direction BR. The shock-absorbing shell 1 reaches these two stop elements 23.1, 23.*r* in case of a very high load only.

Especially the following steps are preferably carried out during the assembly of the safety helmet 100:

- The components of the safety helmet 100 are provided. They may be manufactured at different locations.
- The shock-absorbing shell 1 is inserted into the helmet shell 2 on the inside.
- The rear holding ring part 11 is placed on the shock-absorbing shell 1 and is screwed onto the helmet shell 2 from the inside.
- The front holding ring part 3 is likewise placed on the shock-absorbing shell 1 and is screwed to the helmet shell 2 from the inside.
- The front bearing ring part 6 is connected to the front holding ring part 3.
- The rear bearing ring parts 7.1, 7.*r*, 10 are likewise connected to the front holding ring part 3.
- The front bearing ring part 6 is connected to the rear bearing ring parts 7.1, 7.*r*.

The shock-absorbing shell 7 is preferably inserted first into the helmet shell 2 on the inside. The holding ring parts 11, 3 as well as the bearing ring parts 6, 7.1, 7.*r*, 10 are subsequently connected to the helmet shell 2.

While specific embodiments of the invention have been shown and described in detail to illustrate the application of the principles of the invention, it will be understood that the invention may be embodied otherwise without departing from such principles.

LIST OF REFERENCE CHARACTERS

1 Arched shock-absorbing shell, inserted into the helmet shell 2 on the inside; it comprises the lateral recesses 17.1, 17.*r*, the central recess 18, the two central projections 21.*h*, 21.*v* as well as the shock-absorbing shell edge K.1

2 Arched helmet shell made of a hard material, to which the front holding ring part 3 and the rear holding ring part 11 are attached

3 Front holding ring part in the form of a half ellipse, connected from the inside by the screw connections 16.1, **16.*r* to the helmet shell 2; it has the front holding ring edge K.3**

4 Pivotable visor, attached to the helmet shell 2

5.1 Left screw connection, which connects the additional visor 26 pivotably to the front holding ring part 3

**5.*r* Right screw connection, which connects the additional visor 26 pivotably to the front holding ring part 3**

6 Front bearing ring, attached by means of the intermediate piece 27 to the front holding ring part 3, detachably connected to the left rear bearing ring part 7

7 Two-part rear bearing ring part; it comprises the two parts 7.1 and **7.*r*, detachably connected to the front bearing ring part 6**

7.1 Left part of the rear bearing ring part 7, connected movably to the central rear bearing ring part 10

**7.*r* Right part of the rear bearing ring part 7, connected movably to the central rear bearing ring part 10**

8.1, **8.*r* Holding arms at the front holding ring part 3**

9.1, **9.*r* Holding arms at the rear bearing ring part 7**

10 Central rear bearing ring part, configured as a bearing support for the back of the head or as a nape bearing support, connected to the rear bearing ring part 7 and to the rear holding ring parte 11

11 Rear holding ring part, arranged behind the rear bearing ring parts 7, 10; it comprises the through holes 12.1, 12.2; it has the rear holding ring edge K.11

12.1, **12.*r* Through holes at the rear holding ring part 11, through which the screws 24.1, 24.*r*** are passed

13.1, **13.*r* Lateral projections, arranged laterally at the top at the rear holding ring part 11; they engage with the projections 17.1, 17.*r***

14 Centrally arranged, resilient projection at the top at the rear holding ring part 11; it engages with the recess 18 in the shock-absorbing shell 1

15 Handwheel for adjusting the head size of the safety helmet 100

16.1 Left screw connection, which detachably connects the front holding ring part 3 to the helmet shell 2 and detachably and pivotably connects the visor 4 to the helmet shell 2

**16.*r* Right screw connection, which detachably connects the front holding ring part 3 to the helmet shell 2 and detachably and pivotably connects the visor 4 to the helmet shell 2**

17.1, **17.*r* Lateral recesses in the shock-absorbing shell 1, with which the projections 13.1, 13.*r* at the holding ring part 11** engage

18 Central recess in the edge of the shock-absorbing shell 1, with which the resilient projection 14 engages

19 Downwards pointing, front edge area of the shock-absorbing shell edge L.1; it lies on the obliquely rising area K.**3*v* of the front holding ring edge K.3 of the front holding ring part 3; it comprises the segment 19.*v***

**19.*v* Obliquely rising segment of the front edge area 19 of the shock-absorbing shell edge K.1; it lies on the front holding ring edge K.3**

20.1, **20.*r* Serrated areas of the shock-absorbing shell edge K.1; they are normally located at a distance from the serrated areas 23.1, 23.*r* of the front holding ring edge K.3**; they lie on these in case of a very high load

**21.*h* Rear central projection at the shock-absorbing shell 1; it engages with the groove 29**

**21.*v* Front central projection at the shock-absorbing shell 1; it abuts against the stop elements 22.*h* and 22.*v***

**22.*h* Rear, centrally arranged projection in the helmet shell 2; it forms a stop element for the projection 21.*v* in one embodiment; it belongs to a snap-in connection for the visor 7** in one embodiment

**22.*v* Front, centrally arranged projection in the helmet shell 2; it forms a stop element for the projection 21.*v***

23.1, **23.*r* Serrated areas of the front holding ring edge K.3**

24.1, **24.*r* Screws, which are passed through the through holes 12.1, 12.*r* and are screwed into the threads 25.1, 25.*r* and thereby hold the rear holding ring part 11 on the inside at the helmet shell 2**

25.1, **25.*r* Thread on the inside in the helmet shell 2 for the screws 24.1, 24.*r***

26 Additional visor in the form of sunglasses, arranged between the front holding ring parte 3 and the helmet shell 2, attached to the helmet shell 2 with the screw connections 5.1 and **5.*r***

27 Intermediate piece between the front holding ring part 3 and the front bearing ring part 6

28 Centrally arranged, oblong projection on the outside at the shock-absorbing shell 1; it engages with the groove 29

29 Outwards pointing and centrally arranged groove in the rear area of the helmet shell 2, with which the projection 28 engages

100 Safety helmet, comprising the helmet shell 2, the shock-absorbing shell 1, the visor 4, the additional visor 26, the holding ring 3, 11, the bearing ring 6, 7, 10, the intermediate piece 27 and the handwheel 15

BR Viewing direction of a user of the safety helmet 100, who is looking straight forward K.1 Shock-absorbing shell edge, downwards pointing edge of the shock-absorbing shell 1; it comprises the front edge area 19 and the serrated areas 20.1, **20.*r***

K.3 Front holding ring edge, upwards pointing edge of the front holding ring part 3; it comprises the front area K.**3*v***

K.**3*v* Obliquely rising front area of the front holding ring edge K.3**

K.11 Upwards pointing rear holding ring edge of the rear holding ring part 11

What is claimed is:

1. A safety helmet comprising:

an arched helmet shell encompassing a helmet shell interior area;

a holding ring with a curved holding ring edge, the holding ring being located in the helmet shell interior area and permanently connected to the arched helmet shell;

an arched shock-absorbing shell with a curved shock-absorbing shell edge, the arched shock-absorbing shell being located in the helmet shell interior area, adjoining the arched helmet shell and configured to absorb kinetic energy, wherein the curved shock-absorbing shell edge areally adjoins the curved holding ring edge; and a resilient element projection located in the helmet shell interior area, the resilient element projection comprising an end portion supported at the holding ring, the end portion engaging an outer surface of the holding ring, wherein the resilient element projection touches the curved shock-absorbing shell edge and the resilient element projection is configured to move the arched shock-absorbing shell away from the holding ring and to press the arched shock-absorbing shell against the arched helmet shell.

2. A safety helmet in accordance with claim 1, wherein:
the holding ring comprises a holding ring projection pointing towards the arched shock-absorbing shell;
the holding ring projection engages with a corresponding recess of the arched shock-absorbing shell;
the one end portion is located at a position outside of the holding ring;
the resilient element projection comprises a second end portion touching the curved shock-absorbing shell edge;
the resilient element projection being located at a spaced location from the arched helmet shell; and
the second end portion is located at a position outside of the arched shock-absorbing shell.

3. A safety helmet in accordance with claim 2, wherein the holding ring projection is located between the arched helmet shell and the arched shock-absorbing shell.

4. A safety helmet in accordance with claim 1, wherein:
the arched shock-absorbing shell comprises a shock-absorbing shell projection pointing towards the arched helmet shell;
the arched helmet shell comprises a stop element pointing towards the arched shock-absorbing shell; and
the shock-absorbing shell projection and the stop element together limit a movement of the arched shock-absorbing shell relative to the arched helmet shell in at least one direction.

5. A safety helmet in accordance with claim 1, wherein:
the curved holding ring edge extends in a plane and has at least one adjoining protruding area, protruding from this plane, which at least one adjoining protruding area adjoins the curved shock-absorbing shell edge; and
a profile of the at least one adjoining protruding area corresponds to a profile of an adjoining area of the curved shock-absorbing shell edge.

6. A safety helmet in accordance with claim 1, wherein:
the arched shock-absorbing shell has an outwardly arched projection;
the arched helmet shell has a groove; and
the projection of the arched shock-absorbing shell engages with the groove of the arched helmet shell.

7. A safety helmet in accordance with claim 1, further comprising a bearing ring, wherein:
the bearing ring encompasses the head of a user of the safety helmet and is configured to be in contact with the head of the user of the safety helmet in at least one area; and
a distance is formed between the holding ring and the bearing ring.

8. A safety helmet in accordance with claim 7, wherein:
a circumferential dimension of the bearing ring is variable; and
a distance is formed between the arched shock-absorbing shell and the bearing ring.

9. A process for manufacturing a safety helmet, the process comprising the steps of:
providing an arched helmet shell encompassing a helmet shell interior area;
providing a holding ring with a curved holding ring edge;
providing an arched shock-absorbing shell with a curved shock-absorbing shell edge, the arched shock-absorbing shell being configured to absorb kinetic energy;
providing at least one resilient element projection located in the helmet shell interior area, the resilient element projection comprising an end portion supported at the holding ring, the end portion engaging an outer surface of the holding ring; wherein the resilient element projection touches the curved shock-absorbing shell edge;
inserting the shock-absorbing shell into the helmet shell interior area such that the shock-absorbing shell is located in the helmet shell interior area and adjoins the arched helmet shell;
subsequent to the step of inserting the shock-absorbing shell, inserting the holding ring into the helmet shell interior area such that the shock-absorbing shell edge areally adjoins the holding ring edge and the resilient element presses the shock-absorbing shell away from the holding ring and against the helmet shell; and
permanently connecting the inserted holding ring to the arched helmet shell with the resilient element pressing the shock-absorbing shell against the arched helmet shell.

10. A process according to claim 9, further comprising providing a computer program, which is executable on a computer and causes the computer during the execution to actuate one or more 3D printers such that an actuated 3D printer produces at least one of the shock-absorbing shell, the holding ring, and the resilient element.

11. A process according to claim 9, further comprising providing a 3D printer, which is configured to produce at least one of the shock-absorbing shell, the holding ring, and the resilient element.

12. A process according to claim 11, further comprising:
providing at least another 3D printer configured to produce at least one of the shock-absorbing shell, the holding ring and the resilient element;
producing at least one of the shock-absorbing shell, the holding ring and the resilient element with the other 3D printer.

13. A process according to claim 12, wherein the 3D printer and the other 3D printer:
are at different locations; or
produce different components of the safety helmet; or
are at different locations and produce different components of the safety helmet.

14. A safety helmet comprising:
an arched helmet shell encompassing a helmet shell interior area;
a holding ring with a curved holding ring edge, the holding ring being located in the helmet shell interior area and permanently connected to the arched helmet shell;
an arched shock-absorbing shell with a curved shock-absorbing shell edge, the arched shock-absorbing shell being located in the helmet shell interior area, adjoining the arched helmet shell and configured to absorb kinetic energy, wherein the arched shock-absorbing shell edge areally adjoins the curved holding ring edge; and
a resilient element located in the helmet shell interior area and supported at an outer surface of the holding ring, wherein the resilient element is in contact with the arched shock-absorbing shell edge and the outer surface of the holding ring, the resilient element being configured to apply a force to the arched shock-absorbing shell such the arched shock-absorbing shell moves away from the holding ring and presses the arched shock-absorbing shell against the arched helmet shell.

15. A safety helmet in accordance with claim 14, wherein:
the holding ring comprises a projection pointing towards the arched shock-absorbing shell;
the projection engages with a corresponding recess of the arched shock-absorbing shell;

the resilient element being located at a spaced location from the arched helmet shell; and each and every portion of the resilient element is located outside of the arched shock-absorbing shell and the holding ring.

16. A safety helmet in accordance with claim 15, wherein the projection is located between the arched helmet shell and the arched shock-absorbing shell.

17. A safety helmet in accordance with claim 14, wherein:

the arched shock-absorbing shell comprises a projection pointing towards the arched helmet shell;

the arched helmet shell comprises a stop element pointing towards the arched shock-absorbing shell; and the projection and the stop element together limit a movement of the arched shock-absorbing shell relative to the arched helmet shell in at least one direction.

18. A safety helmet in accordance with claim 14, wherein:

the curved holding ring edge extends in a plane and has at least one adjoining protruding area, protruding from this plane, which at least one adjoining protruding area adjoins the curved shock-absorbing shell edge; and a profile of the at least one adjoining protruding area corresponds to a profile of an adjoining area of the curved shock-absorbing shell edge.

19. A safety helmet in accordance with claim 14, wherein the resilient element is in contact with a bottom portion of the shock-absorbing shell, the resilient element being configured to press the shock-absorbing shell from a position below the shock-absorbing shell such that the shock-absorbing shell is movable in an upward direction against the helmet shell. .

* * * * *